US005496694A

United States Patent [19]

Kikuchi et al.

[11] Patent Number: 5,496,694

[45] **Date of Patent: *Mar. 5, 1996**

[54] SILVER HALIDE PHOTOGRAPHIC LIGHT-SENSITIVE MATERIAL

[75] Inventors: Makoto Kikuchi; Tetsuo Okutsu, both of Minami-Ashigara, Japan

[73] Assignee: Fuji Photo Film Co., Ltd., Kanagawa, Japan

[ * ] Notice: The termof this patent shall not extend beyond the expiration date of Pat. No. 5,389,508.

[21] Appl. No.: 204,659

[22] Filed: Mar. 2, 1994

[30] Foreign Application Priority Data

Mar. 2, 1993 [JP] Japan ..... 5-64789

[51] Int. Cl.[6] ..... G03C 1/005

[52] U.S. Cl. ..... 430/567; 430/569

[58] Field of Search ..... 430/567, 569

[56] References Cited

U.S. PATENT DOCUMENTS 4,434,226 2/1984 Wilgus et al. ..... 430/567

4,806,461 2/1989 Ikeda et al. ..... 430/567

5,389,508 2/1995 Takada et al. ..... 430/567

FOREIGN PATENT DOCUMENTS 2-68538 3/1988 Japan .

*Primary Examiner*—Richard L. Schilling

*Assistant Examiner*—Mark F. Huff

*Attorney, Agent, or Firm*—Birch, Stewart, Kolasch & Birch

[57] ABSTRACT

A silver halide photographic light-sensitive material includes a support having provided thereon a silver halide emulsion layer containing a silver halide emulsion in which, when that a specific silver iodide content is I mol % ($0.3<I<20$), silver halide grains having a silver iodide content ranging between 0.7I and 1.3I and containing 10 or more dislocation lines per grain account for 100 to 50% of all grains, and an average aspect ratio of all tabular grains is 8 to 40.

17 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material and, more particularly, to a photographic light-sensitive material with a low fog and a high sensitivity.

2. Description of the Related Art

Methods of manufacturing and techniques of using tabular silver halide grains (to be referred to as "tabular grains" hereinafter) are disclosed in U.S. Pat. Nos. 4,434,226, 4,439,520, 4,414,310, 4,433,048, 4,414,306, and 4,459,353, JP-A-59-99433 ("JP-A" means Unexamined Published Japanese Patent Application), and JP-A-62-209445. Known advantages of grains of this type are an increase in sensitivity including an improvement in color sensitization efficiency obtained by sensitizing dyes, an improvement in a sensitivity/graininess relationship, an improvement in sharpness derived from specific optical properties of tabular grains, and an improvement in covering power.

In addition, JP-A-4-18242, JP-A-4-181939, and JP-A-4-190226 disclose that tabular grains in which the distribution of the silver iodide contents of individual grains is narrow have excellent photographic characteristics, such as a high sensitivity, a high gamma, and an improved rate of development.

In recent years, however, requirements for photographic silver halide emulsions have become strict more and more, and so a demand has arisen for a higher aspect ratio of tabular grains for the purpose of increasing the sensitivity, improving the sensitivity/graininess relationship, and increasing the sharpness.

It is, however, impossible to simultaneously achieve a high aspect ratio of tabular grains and a narrow distribution of the silver iodide contents of individual tabular grains. Therefore, the above requirements cannot be realized sufficiently by the conventional techniques.

JP-A-1-329231, on the other hand, discloses that tabular grains each containing 10 or more dislocation lines in its fringe portion have superior photographic characteristics, such as a high sensitivity, a good gradation, and an improved fog.

Introducing dislocation lines uniformly between grains at a high density is desirable in respect of concentration of latent image formation sites and effective chemical sensitization.

It is, however, impossible to realize both of a high aspect ratio of tabular grains and introduction of dislocation lines uniform between grains at a high density. The conventional techniques are unsatisfactory for this purpose.

The present invention aims at achieving both a high aspect ratio of silver halide tabular grains and a narrow distribution of the silver iodide contents of individual grains, and also aims to realize all of a high aspect ratio of tabular grains, introduction of dislocation lines uniform between grains at a high density, and a narrow distribution of the silver iodide contents of individual grains. More specifically, the present invention aims to perform uniform chemical sensitization for high-aspect-ratio silver halide tabular grains, which cannot be sufficiently done by the conventional techniques, i.e., aims to eliminate nonuniformity of chemical sensitization between grains.

SUMMARY OF THE INVENTION

It is an object of the present invention to provide a silver halide emulsion and a photographic light-sensitive material which have a low fog and a high sensitivity.

The above object of the present invention has been achieved by the following means:

(1) A silver halide photographic light-sensitive material comprising a support having provided thereon a silver halide emulsion layer containing a silver halide emulsion in which, when a specific silver iodide content is I mol % ($0.3<I<20$), silver halide grains having a silver iodide content ranging between 0.7I and 1.3I account for 100 to 50% of all grains, and an average aspect ratio of all tabular grains is 8 to 40.

(2) The material described in item (1) above, wherein the silver halide emulsion is an emulsion in which, assuming that a specific silver iodide content is I mol % ($0.3<I<20$), silver halide grains having a silver iodide content ranging between 0.7I and 1.3I and containing 10 or more dislocation lines per grain account for 100 to 50% of all grains, and an average aspect ratio of all tabular grains is 8 to 40.

(3) The material described in item (1) above, wherein the silver halide emulsion is an emulsion in which, when a specific silver iodide content is I mol % ($0.3<I<20$), silver halide grains having a silver iodide content ranging between 0.7I and 1.3I account for 100 to 50% of all grains, and an average aspect ratio of all tabular grains is 12 to 40.

(4) The material described in item (1) above, wherein the silver halide emulsion is an emulsion in which, when a specific silver iodide content is I mol % ($0.3<I<20$), silver halide grains having a silver iodide content ranging between 0.7I and 1.3I and containing 10 or more dislocation lines per grain account for 100 to 50% of all grains, and an average aspect ratio of all tabular grains is 12 to 40.

(5) The material described in item (1) above, wherein the silver halide emulsion is an emulsion in which hexagonal tabular grains, in each of which a ratio of a length of an edge with a maximum length to a length of an edge with a minimum length is 2 to 1, account for 100 to 50% of a total projected area of all grains.

(6) The material described in item (1) above, wherein the silver halide emulsion is an emulsion in which a variation coefficient of diameters of projected areas of all grains is 20 to 3%.

(7) The material described in item (1) above, wherein the silver halide emulsion is an emulsion in which silver halide grains are formed while iodide ions are rapidly being generated.

(8) The material described in item (7) above, wherein said iodide ions are generated from an iodide ion-releasing agent placed in a reaction vessel, 50 to 100% of said iodide ion-releasing agent completes release of iodide ions within 180 consecutive seconds in the reaction vessel.

(9) The material described in item (7) above, wherein said iodide ions are rapidly being generated by a reaction of an iodide ion-releasing agent with an iodide ion release-controlling agent.

(10) The material described in item (7) above, wherein said reaction which iodide ions are rapidly being generated is a second-order reaction essentially proportional to a concentration of the iodide ionreleasing agent and a concentration of an iodide ion release-controlling agent, and a rate constant of the second-order reaction is 1,000 to $5\times10^{-3}$ $M^{-1}.sec^{-1}$.

(11) The material described in item (7) above, wherein iodide ions are rapidly being generated from an iodide ion-releasing agent represented by Formula (I) below:

Formula (I)

R—I wherein R represents a monovalent organic residue which release the iodine atoms in the form of iodide ions upon reacting with a base and/or a nucleophilic reagent.

Emulsions of the present invention will be described below.

The tabular grain of the present invention is a silver halide grain having two parallel major planes opposing each other.

The tabular grain of the present invention has one twin plane or two or more parallel twin planes.

A twin plane is a (111) face if ions at all lattice points on the both sides of this (111) face have a mirror-image relationship.

When this tabular grain is viewed from the above, the grain looks like a triangle, a hexagon, or a rounded triangle or hexagon having parallel outer surfaces.

A ratio of the diameter of a silver halide grain to its thickness is termed an aspect ratio.

That is, the aspect ratio is a value obtained by dividing the equivalent-circle diameter of the projected area of a silver halide grain by the thickness of that grain.

The aspect ratio can be measured by, e.g., a replica method in which the diameter of a circle (equivalent-circle diameter) having an area equal to the projected area of each grain and the thickness of the grain are obtained from transmission electron micrographs.

In this method, the thickness is calculated from 10 the length of the shadow of a replica.

An average aspect ratio is the arithmetic mean of the aspect ratios of all tabular grains contained in an emulsion.

In the emulsion of the present invention, the average aspect ratio of all tabular grains is preferably 8 to 40, more preferably 12 to 30, and most preferably 15 to 30.

To take advantage of the maximum of the merit of tabular grains, an emulsion with an average aspect ratio of 8 or more is preferred. However, an average aspect ratio greater than 40 is unpreferred because a resistance to pressure is lowered.

The equivalent-circle diameter of the tabular grain of the present invention is preferably 0.3 to 10 μm, more preferably 0.4 to 5 μm, and most preferably 0.5 to 4 μm.

An equivalent-circle diameter smaller than 0.3 μm is unpreferred because the merit of tabular grains cannot be satisfactorily taken advantage of. If the equivalent-circle diameter exceeds 10 μm, a resistance to pressure is undesirably decreased.

The thickness of the tabular grain of the present invention is preferably 0.05 to 1.0 μm, more preferably 0.08 to 0.5 μm, and most preferably 0.08 to 0.3 μm.

A grain thickness smaller than 0.05 μm is unpreferred because a resistance to pressure is lowered. A grain thickness larger than 1.0 μm is also unpreferred because it is not possible to make the best use of the merit of tabular grains.

In an emulsion of the present invention, hexagonal tabular grains in each of which the ratio of the length of an edge having the maximum length to the length of an edge having the minimum length is 2 to 1 occupy preferably 100 to 50%, more preferably 100 to 70%, and most preferably 100 to 90% of the total projected area of all grains contained in the emulsion. Mixing of hexagonal tabular grains other than the above hexagonal tabular grains is unpreferred in terms of homogeneity between grains.

The emulsion of the present invention is preferably monodisperse.

The variation coefficient of the equivalent-circle diameters of the projected areas of all silver halide grains is preferably 20 to 3%, more preferably 15 to 3%, and most preferably 10 to 3%. A variation coefficient greater than 20% is unpreferable in terms of uniformity between grains.

The variation coefficient of equivalent-circle diameters is a value obtained by dividing the standard deviation of the equivalent-circle diameters of individual silver halide grains by an average equivalent-circle diameter.

The emulsion grain of the present invention consists of a silver halide containing silver iodide, and has at least one of a silver iodide phase, a silver iodobromide phase, a silver bromochloroiodide phase, and a silver iodochloride phase.

The silver halide grain may contain another silver salt, such as silver rhodanate, silver sulfide, silver selenide, silver carbonate, silver phosphate, or an organic acid silver salt, as another grain or as a portion of the silver halide grain.

The composition of the tabular grain of the present invention is preferably silver iodobromide or silver bromochloroiodide.

The range of the silver iodide contents of emulsion grains of the present invention is preferably 0.1 to 20 mol %, more preferably 0.3 to 15 mol %, and most preferably 1 to 10 mol %, but it can be chosen in accordance with the intended use. A silver iodide content exceeding 20 mol % is unpreferable because the rate of development is generally lowered.

Nucleation of the tabular grains of the present invention will be described below.

In the present invention, it is favorable to perform a method of forming tabular grains having a high monodispersibility and a high aspect ratio at any temperature that can be easily used in practice by defining a time required for nucleation by using the function of a temperature. When an aqueous silver nitrate solution and an aqueous potassium bromide solution are added to a reaction solution, precipitation of a silver halide occurs immediately. Although the number of the fine silver halide grains produced increases while silver ion and bromide ion are added, it does not increase in proportion to the time. That is, the increase in number becomes moderate gradually, and the number finally becomes a constant value. The silver halide grains produced by the precipitation starts growing immediately after the forming of the grains. Nuclei produced earlier grow more easily, and those produced later are more difficult to grow. If a variation occurs in size of nuclei in growth during the nucleation, this variation is further increased in the subsequent Ostwald ripening. The extent of the size distribution of nuclei occurring in the nucleation is determined by the nucleation time and the temperature of a reaction solution. The extent of the size distribution starts when 60 seconds elapse, for nucleation performed at 30° C. This polydispersion starts when 30 seconds elapse, for nucleation performed at 70° C., and 15 seconds elapse, for nucleation performed at 75° C. A time before the start of this extent of the size distribution depends on the temperature during nucleation because this time reflects the time required for fine silver halide grains to dissolve. Completing nucleation within this time interval makes it possible to form tabular grains with a high aspect ratio at any temperature that is practically, easily usable, without impairing the monodispersibility.

Known examples of a method of nucleation are a socalled single-jet method, in which only an aqueous silver nitrate solution is added to a halide salt solution, and a double-jet method, in which an aqueous silver nitrate solution and an aqueous halide salt solution are added simultaneously. Preferable nucleation conditions of the present invention require a high generation probability of twinning nuclei. Therefore, the double-jet method, in which these nuclei are easy to generate because of a high degree of supersaturation in a stirring/mixing device, is more favorable.

Although the nucleation can be performed between 20° C. and 60° C., it is preferably performed between 30° C. 60° C. in terms of suitability for manufacture, such as a high generation probability of twinning nuclei. After the nucleation, the temperature is raised, the pAg is controlled to 7.6 to 10.0, and physical ripening is performed to eliminate grains other than tabular grains. After tabular grains alone are thus obtained, desired tabular seed crystal grains are formed through a process of grain growth. In the grain growth process, it is desirable to add silver and a halogen solution in order that no new crystal nuclei are generated. The aspect ratio of emulsion grains can be controlled by selecting the temperature and the pAg and the addition rates of an aqueous silver nitrate solution and an aqueous halide solution to be added, in the grain growth process.

In addition, as described in JP-A-62-99751, a portion or all of silver to be added in the grain growth process can be supplied in the form of fine silver halide grains.

In the emulsion of the present invention, when a specific silver iodide content is I mol % ($0.3<I<20$), silver halide grains with silver iodide content ranging between 0.7I and 1.3I account for preferably 100 to 50%, more preferably 100 to 70%, and most preferably 100 to 90% of all grains.

The value of the specific silver iodide content I is a given value within the range of ($0.3<I<20$). For example, a mean value obtained when the silver iodide contents of individual grains are measured may be selected as the specific silver iodide content I.

The "specific silver iodide content (I mol %)" concerned with the emulsion of the present invention is a specific silver iodide content having a value close to an average silver iodide content calculated in the formulation of that emulsion. I takes a specific value within the range of 0.3 to 20 mol %. By measuring the silver iodide contents of specific emulsion grains isolated from a specific emulsion layer of a silver halide photographic light-sensitive material, it is possible to specify the silver iodide contents such that as many grains as possible fall within the range of 0.7I to 1.3I. Generally, the specific silver iodide content takes a value close to the arithmetic mean of the silver iodide contents of the specific emulsion grains described above. It is practical to set the I value at an average silver iodide content in the formulation or at an average silver iodide content actually measured.

The silver iodide contents of individual emulsion grains can be measured by analyzing the composition of each grain by using an X-ray microanalyzer.

This method of measurement is described in, e.g., European Patent 147,868.

The distribution of the silver iodide contents of individual grains contained in the emulsion of the present invention is obtained by measuring the silver iodide contents of preferably 100 or more, more preferably 200 or more, and most preferably 300 or more grains.

The tabular grain of the present invention preferably has dislocation lines.

A dislocation line is a linear lattice defect at the boundary between a region already slipped and a region not slipped yet on a slip plane of crystal.

Dislocation lines in silver halide crystal are described in, e.g., 1) C. R. Berry. J. Appl. Phys., 27, 636 (1956), 2) C. R. Berry, D. C. Skilman, J. Appl. Phys., 35, 2165 (1964), 3) J. F. Hamilton, Phot. Sci. Eng., 11, 57 (1967), 4) T. Shiozawa, J. Soc. Sci. Jap., 34, 16 (1971), and 5) T. Shiozawa, J. Soc. Phot. Sci. Jap., 35, 213 (1972). Dislocation lines can be analyzed by an X-ray diffraction method or a direct observation method using a low-temperature transmission electron microscope.

In direct observation of dislocation lines using a transmission electron microscope, silver halide grains, extracted carefully from an emulsion so as not to apply a pressure at which dislocation lines are produced in the grains, are placed on a mesh for electron microscopic observation. While the sample is cooled in order to prevent damage (e.g., print out) owing to electron rays, the observation is performed by a transmission method.

In this case, as the thickness of a grain is increased, it becomes more difficult to transmit electron rays through it. Therefore, grains can be observed more clearly by using an electron microscope of a high voltage type (200 kV or more for a thickness of 0.25 μm).

Effects that dislocation lines have on photographic performance are described in G. C. Farnell, R. B. Flint, J. B. Chanter, J. Phot. Sci., 13, 25 (1965). This literature demonstrates that in a large tabular silver halide grain with a high aspect ratio, a location at which a latent image speck is formed has a close relationship with a defect in the grain.

JP-A-63-220238 and JP-A-1-201649 disclose tabular silver halide grains to which dislocation lines are introduced intentionally.

These patent applications indicate that tabular grains to which dislocation lines are introduced are superior to those having no dislocation lines in photographic characteristics, such as sensitivity and reciprocity.

In the present invention, it is preferable to introduce dislocation lines into a silver halide grain as follows.

That is, a silver halide phase containing silver iodide is epitaxially grown on a tabular grain (also called a host grain) as a substrate, and then silver halide shell is formed, thereby introducing dislocation lines.

Although the silver iodide content of the host grain is preferably 0 to 15 mol %, more preferably 0 to 12 mol %, and most preferably 0 to 10 mol %, it can be chosen in accordance with the intended use.

A silver halide content greater than 15 mol % is generally unpreferable because the rate of development is lowered.

It is preferable that the silver halide content of the silver halide phase to be epitaxially grown be higher than that of the host grain.

The silver halide phase to be epitaxially grown can be any of silver iodide, silver iodobromide, silver bromochloroiodide, and silver iodochloride, but it is preferably silver iodide or silver iodobromide, and more preferably silver iodide.

In the case of silver iodobromide, the silver iodide (iodide ion) content is preferably 1 to 45 mol %, more preferably 5 to 45 mol %, and most preferably 10 to 45 mol %. Although a higher silver iodide content is more favorable in order to form miss fit required for introduction of dislocation lines, 45 mol % is the solid solution limit of silver iodobromide.

A halogen amount to be added to form this high silver iodide content phase which is performed for an epitaxial growth on the host grain is preferably 2 to 15 mol %, more preferably 2 to 10 mol %, and most preferably 2 to 5 mol % with respect to the silver amount of the host grain.

A halogen amount smaller than 2 mol % is unpreferred because dislocation lines are difficult to introduce. If the halogen amount exceeds 15 mol %, the rate of development is undesirably lowered.

The high silver iodide content phase falls within the range of preferably 5 to 80 mol %, more preferably 10 to 70 mol %, and most preferably 20 to 60 mol % with respect to the silver amount of an entire grain.

A silver amount either smaller than 5 mol % or larger than 80 mol % is unpreferred because it becomes difficult to increase sensitivity by introduction of dislocation lines.

A location on the host grain where the high silver iodide content phase is to be formed can be any given position. Although the high silver iodide content phase can be formed to cover the host grain or in its particular portion, it is preferable to control the positions of dislocation lines inside a grain by epitaxially growing the phase at a specific portion selected.

It is most preferable to form the high silver iodide content phase on the edge of the host tabular grain. In this case, it is possible to freely select the composition of a halogen to be added, the addition method, the temperature of a reaction solution, the pAg, the solvent concentration, the gelatin concentration, and the ion intensity.

After epitaxial growth is performed, dislocation lines are introduced by forming a silver halide shell outside the host tabular grain.

The composition of this silver halide shell may be any of silver bromide, a silver bromoiodide, and silver bromochloroiodide, but it is preferably silver bromide or silver iodobromide.

When the silver halide shell consists of silver bromoiodide, the silver iodide content is preferably 0.1 to 12 mol %, more preferably 0.1 to 10 mol %, and most preferably 0.1 to 3 mol %.

If the silver iodide content is less than 0.1 mol %, it becomes difficult to obtain effects of enhancing dye adsorption and accelerating development. A silver iodide content greater than 12 mol % is also unpreferable because the rate of development is lowered.

A silver amount used in the growth of this silver halide phase can take any given value as long as it is 5 mol % or more of the host grain.

In the above process of introducing dislocation lines, the temperature is preferably 30° to 80° C., more preferably 35° to 75° C., and most preferably 35° to 60° C.

A manufacturing apparatus with a high performance is necessary to perform temperature control at low temperatures lower than 30° C. or high temperatures higher than 80° C. Therefore, these temperatures are unpreferable in the manufacture.

A preferable pAg is 6.4 to 10.5.

In the case of tabular grains, the positions and the numbers of dislocation lines of individual grains viewed in a direction perpendicular to their major planes can be obtained from photographs of the grains taken by using an electron microscope.

Note that dislocation lines can or cannot be seen depending on the angle of inclination of a sample with respect to electron rays. Therefore, in order to observe dislocation lines without omission, it is necessary to obtain the positions of dislocation lines by observing photographs of the same grain taken at as many sample inclination angles as possible.

In the present invention, it is favorable to take five photographs of the same grain at inclination angles different by a 5° step by using a high-voltage electron microscope, thereby obtaining the positions and the number of dislocation lines.

In the present invention, when dislocation lines are to be introduced inside a tabular grain, the positions of the dislocation lines may be limited to the corners or the fringe portion of the grain, or the dislocation lines may be introduced throughout the entire major planes. It is, however, preferable to limit the positions of the dislocation lines to the fringe portion.

In the present invention, the "fringe portion" means the peripheral region of a tabular grain. More specifically, the fringe portion is a region outside a certain position where, in a distribution of silver iodide from the edge to the center of a tabular grain, a silver iodide content from the edge side becomes either higher or lower than the average silver iodide content of the overall grain for the first time.

In the present invention, it is preferable to introduce dislocation lines at a high density inside a silver halide grain.

Each tabular grain of the present invention has preferably 10 or more, more preferably 30 or more, and most preferably 50 or more dislocation lines in its fringe portion when the dislocation lines are counted by the method using an electron microscope described above.

If dislocation lines are densely present or cross each other, it is sometimes impossible to accurately count the dislocation lines per grain.

Even in these situations, however, dislocation lines can be roughly counted to such an extent as in units of 10 lines.

It is desirable that the distribution of dislocation line quantities be uniform between individual silver halide grains.

In the emulsion of the present invention, tabular grains containing 10 or more dislocation lines per grain occupy preferably 100 to 50% (number), more preferably 100 to 70%, and most preferably 100 to 90% of all grains.

A ratio lower than 50% is unpreferred in respect of uniformity between grains.

In the present invention, in order to obtain the ratio of grains containing dislocation lines and the number of dislocation lines, it is preferable to directly observe dislocation lines for at least 100 grains, more preferably 200 grains, and most preferably 300 grains.

The effect of the present invention was remarkable when a silver halide phase containing silver iodide was formed while iodide ions are rapidly being generated by using an iodide ion-releasing agent represented by Formula (I), instead of the use of the conventional method of supplying iodide ions (the method of adding free iodide ions), during epitaxial growth in the process of introducing dislocation lines into the tabular grains described above.

The iodide ion-releasing agent represented by Formula (I) of the present invention overlaps in part with compounds used to obtain a uniform halogen composition in each silver halide grain and between individual grains in JP-A-2-68538 described above.

It is, however, totally unexpected for the present invention to find that a silver halide emulsion having a low fog, a high sensitivity, and an improved resistance to pressure can be obtained by performing formation of silver halide grains while iodide ions are rapidly being generated in the presence of an iodide ion-releasing agent represented by Formula (I).

An iodide ion-releasing agent represented by Formula (I) below of the present invention will be described in detail.

Formula (I)

R—I where R represents a monovalent organic residue which releases the iodine atom, I, in the form of iodide ions upon reacting with a base and/or a nucleophilic reagent.

The details of a compound represented by Formula (I) will be described. Preferable examples of R are an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl or aryloxycarbonyl group having 2 to 30 carbon atoms, an alkyl or arylsulfonyl group having 1 to 30 carbon atoms, and a sulfamoyl group.

R is preferably one of the above groups having 20 or less carbon atoms, and most preferably one of the above groups having 12 or less carbon atoms.

The number of carbon atoms preferably falls within the above with respect to the solubility and the addition amount.

It is also preferable that R be substituted, and examples of preferable substituents are as follows. These substituents may be further substituted by other substituents.

Examples are a halogen atom (e.g., fluorine, chlorine, bromine, and iodine), an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkynyl group (e.g., propargyl and 3-pentynyl), an aralkyl group (e.g., benzyl and phenethyl), an aryl group (e.g., phenyl, naphthyl, and 4-methylphenyl), a heterocyclic group (e.g., pyridyl, furyl, imidazolyl, piperidyl, and morpholyl), an alkoxy group (e.g., methoxy, ethoxy, and butoxy), an aryloxy group (e.g., phenoxy and naphthoxy), an amino group (e.g., unsubstituted amino, dimethylamino, ethylamino, and anilino), an acylamino group (e.g., acetylamino and benzoylamino), a ureido group (e.g., unsubstituted ureido, N-methylureido, and N-phenylureido), a urethane group (e.g., methoxycarbonylamino and phenoxycarbonylamino), a sulfonylamino group (e.g., methylsulfonylamino and phenylsulfonylamino), a sulfamoylamino group (e.g., sulfamoyl, N-methylsulfamoyl, and N-phenylsulfamoyl), a carbamoyl group (e.g., carbamoyl, diethylcarbamoyl, and phenylcarbamoyl), a sulfonyl group (e.g., methylsulfonyl and benzenesulfonyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), an amido-phosphoryl group (e.g., N,N-diethylamido-phosphoryl), an alkylthio group (e.g., methylthio and ethylthio), an arylthio group (e.g., a phenylthio group), a cyano group, a sulfo group, a carboxyl group, a hydroxy group, a phosphono group, and a nitro group.

More preferable substituents for R are a halogen atom, an alkyl group, an aryl group, a 5- or 6-membered heterocyclic group containing at least one O, N, or S, an alkoxy group, an aryloxy group, an acylamino group, a sulfamoyl group, a carbamoyl group, an alkylsulfonyl group, an arylsulfonyl group, an aryloxycarbonyl group, an acyl group, a sulfo group, a carboxyl group, a hydroxy group, and a nitro group.

Most preferable substituents for R are a hydroxy group, a carbamoyl group, a lower alkylsulfonyl group, and a sulfo group (including its salt), when substituted on an alkylene group, and a sulfo group (including its salt), when substituted on a phenylene group.

A compound represented by Formula (I) of the present invention is preferably a compound represented by Formula (II) or (III) below.

A compound represented by Formula (II) of the present invention will be described below.

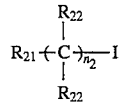

Formula (II)

In Formula (II), $R_{21}$ represents an electron-withdrawing group, and $R_{22}$ represents a hydrogen atom or a substitutable group.

$n_2$ represents an integer from 1 to 6. $n_2$ is preferably an integer from 1 to 3, and most preferably 1 or 2.

The electron-withdrawing group represented by $R_{21}$ is preferably an organic group having a Hammett $\sigma_p$, $\sigma_m$, or $\sigma_I$ value larger than 0.

The Hammett $\sigma_p$ or $\sigma_m$ value is described in "Structural Activity Correlation of Chemicals" (Nanko Do), page 96 (1979), and the Hammett $\sigma_I$ value is described in the same literature, page 105. So the values can be selected on the basis of these tables.

Preferable examples of $R_{21}$ are a halogen atom (e.g., fluorine, chlorine, and bromine), a trichloromethyl group, a cyano group, a formyl group, a carboxylic acid group, a sulfonic acid group, a carbamoyl group (e.g., unsubstituted carbamoyl and diethylcarbamoyl), an acyl group (e.g., acetyl and benzoyl), an oxycarbonyl group (e.g., methoxycarbonyl and ethoxycarbonyl), a sulfonyl group (e.g., methanesulfonyl and benzenesulfonyl), a sulfonyloxy group (e.g., methanesulfonyloxy), a carbonyloxy group (e.g., acetoxy), a sulfamoyl group (e.g., unsubstituted sulfamoyl and dimethylsulfamoyl), and a heterocyclic group (e.g., 2-thienyl, 2-benzoxazolyl, 2-benzothiazolyl, 1-methyl-2-benzimidazolyl, 1-tetrazolyl, and 2-quinolyl). Carbon-containing groups of $R_{21}$ preferably contain 1 to 20 carbon atoms.

Examples of the substitutable group represented by $R_{22}$ are those enumerated above as the substituents for R. A plurality of $R_{22}$'s present in a molecule may be the same or different.

It is preferable that one-half or more of a plurality of $R_{22}$'s contained in a compound represented by Formula (II) be hydrogen atoms.

$R_{21}$ and $R_{22}$ may be further substituted. Preferable examples of the substituents are those enumerated above as the substituents for R.

Also, $R_{21}$ and $R_{22}$ or two or more $R_{22}$'s may combine together to form a 3- to 6-membered ring.

A compound represented by Formula (III) of the present invention will be described below.

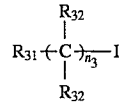

Formula (III)

In Formula (III), $R_{31}$ represents an $R_{33}O$- group, an $R_{33}S$- group, an $(R_{33})_2N$- group, an $(R_{33})_2P$- group, or phenyl, wherein $R_{33}$ represents a hydrogen atom, an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, or a heterocyclic group having 4 to 30 carbon atoms.

The number of carbon atoms preferably falls within the above with respect to the solubility and the addition amount.

If $R_{31}$ represents the $(R_{33})_2N$- group or the $(R_{33})_2P$- group, two $R_{33}$ groups may be the same or different. $R_{31}$ is preferably the $R_{33}O$-group.

$R_{32}$ and $n_3$ have the same meanings as $R_{22}$ and $n_2$ in Formula (II), and a plurality of $R_{32}$'s may be the same or different.

Examples of the substitutable group represented by $R_{32}$ are those enumerated above as the substituents for R. $R_{32}$ is preferably a hydrogen atom.

$n_3$ is preferably 1, 2, 4, or 5, and is most preferably 2.

$R_{31}$ and $R_{32}$ may be further substituted. Preferable examples of the substituents are those enumerated above as the substituents for R.

Also, $R_{31}$ and $R_{32}$, or two or more $R_{32}$'s may bond together to form a ring.

Practical examples of compounds represented by Formulas (I), (II), and (III) of the present invention will be described below, but the present invention is not limited to these examples.

$ICH_2COOH$ (1)

$ICH_2CONH_2$ (2)

$ICH_2CN$ (3)

$I(CH_2)_2COOH$ (4)

$I(CH_2)_3COOH$ (5)

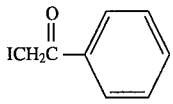
(6)

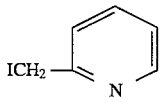
(7)

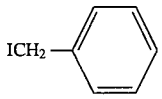
(8)

$I(CH_2)_2SO_3Na$ (9)

$I(CH_2)_2SO_2CH_3$ (10)

$I(CH_2)_2OH$ (11)

$I(CH_2)_3OH$ (12)

$I(CH_2)_4OH$ (13)

$ICH_2CHOH$ (14)
|
$CH_3$ $ICH_2CHOH$ (15)

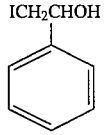

$ICH_2CHCH_2OH$ (16)
|
OH $ICH_2CHCH_2SO_3Na$ (17)
|
OH

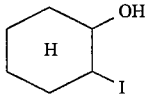
(18)

$ICH_2CHCHCH_2I$ (19)
| |
OHOH

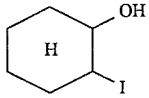
(20)

ICHCOOH (21)
|

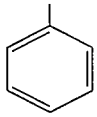

-continued $I(CH_2)_2SO_2CH_2CONH_2$ (22)

$I(CH_2)_2NH_2$ (23)

$I(CH_2)_2NHSO_2CH_3$ (24)

$I(CH_2)_2NHCOCH_3$ (25)

$I(CH_2)_2OCH_3$ (26)

$I(CH_2)_2SCH_3$ (27)

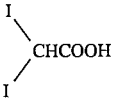
(28)

$ICH_2CHCH_2I$ (29)
|
OH $I(CH_2)_2SO_2NH_2$ (30)

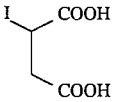
(31)

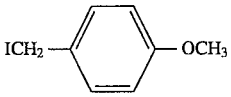
(32)

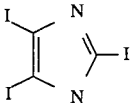
(33)

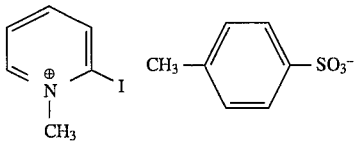
(34)

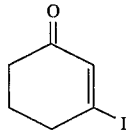
(35)

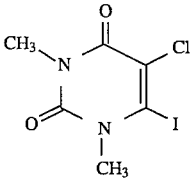
(36)

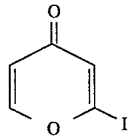
(37)

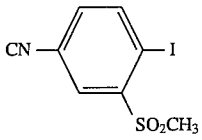
(38)

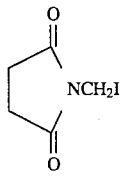
(39)

-continued
(40)
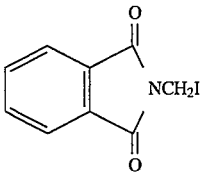
(41)
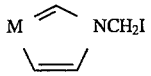
(42)
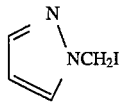
(43)
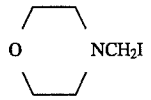
(44)
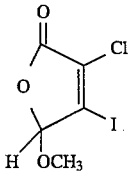
(45)
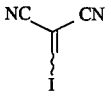
(46)
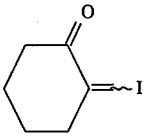
$I(CH_2)_5COOH$ (47)
(48)
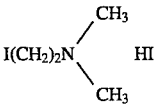
$I(CH_2)_2N(CH_3)SO_2CH_3$ (49)
$I(CH_2)_2OCOCH_3$ (50)
$I(CH_2)_2N(CH_3)COCH_3$ (51)
(52)
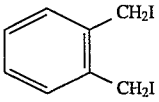
(53)
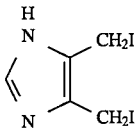
(54)
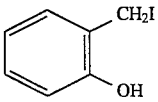
(55)
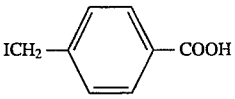
-continued
(56)
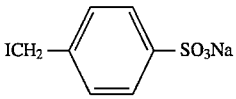
$ICH_2CONH(CH_2)_2-SO_3Na$ (57)
(58)
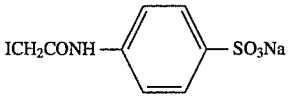
(59)
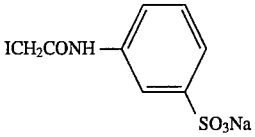
(60)
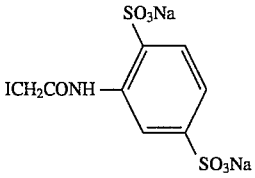
(61)
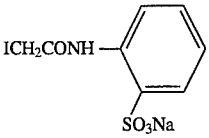
(62)
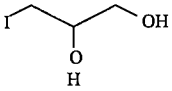
(63)
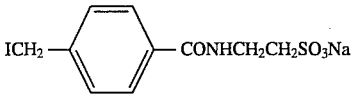
(64)
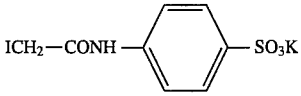
(65)
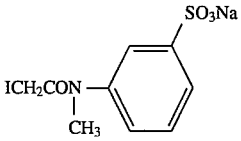
(66)
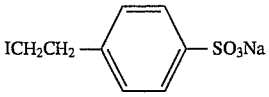
(67)
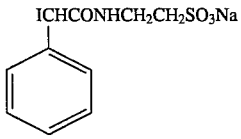
(68)
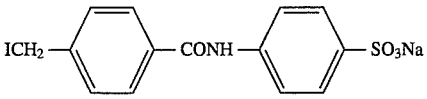
(69)
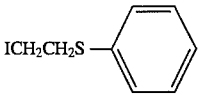

The iodide ion-releasing agent of the present invention can be synthesized in accordance with the following synthesizing methods:

J. Am. Chem. Soc., 76, 3227-8 (1954), J. Org. Chem., 16, 798 (1951), Chem. Ber., 97, 390 (1964), Org. Synth., V, 478 (1973), J. Chem. Soc., 1951, 1851, J. Org. Chem., 19, 1571 (1954), J. Chem. Soc., 1952, 142, J. Chem. Soc., 1955, 1383, Angew, Chem., Int. Ed., 11, 229 (1972), Chem Commu., 1971, 1112.

The iodide ion-releasing agent of the present invention releases iodide ion upon reacting with an iodide ion release-controlling agent (a base and/or a nucleophilic reagent). Preferable examples of the nucleophilic reagent for this purpose are chemical species listed below:

Hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines, and sulfides.

In the present invention, the rate and timing at which iodide ions are released can be controlled by controlling the concentration of a base or a nucleophilic reagent, the addition method, or the temperature of a reaction solution. A preferable example of the base is alkali hydroxide.

The range of concentration of the iodide ion-releasing agent and the iodide ion release-controlling agent for use in the rapid production of iodide ions is preferably $1\times10^{-7}$ to 20 mol, more preferably $1\times10^{-5}$ to 10 mol, further preferably $1\times10^{-4}$ to 5 mol, and most preferably $1\times10^{-3}$ to 2 mol.

A concentration greater than 20 mol is unpreferred since the addition amounts of a silver iodide releasing agent and a silver iodide release control agent both having large molecular weights become too large with respect to the volume of a grain formation vessel.

If the concentration is below $1\times10^{-7}$ mol, the rate of the iodide ion release reaction is lowered, and this makes it difficult to cause the iodide ion releasing agent to abruptly produce iodide ions.

The range of temperature is preferably 30° to 80° C., more preferably 35° to 75° C., and most preferably 35° to 60° C.

Generally, the rate of the iodide ion release reaction becomes very high at temperatures higher than 80° C., and becomes very low at temperatures lower than 30° C. Therefore, these temperatures are undesirable because the use conditions are limited.

In the present invention, changes in solution pH can be used if a base is used in releasing iodide ions.

In this case, the range of pH for controlling the rate and timing at which iodide ions are released is preferably 2 to 12, more preferably 3 to 11, and particularly preferably 5 to 10. The pH is most preferably 7.5 to 10.0 after the control. Hydroxide ion determined by the ion product of water serves as a control agent even under a neutral condition of pH 7.

It is also possible to use the nucleophilic reagent and the base together. Here again, the rate and timing at which iodide ions are released may be controlled by controlling the pH within the above range.

The range of amount of iodide ions released from the iodide ion releasing agent is preferably 0.1 to 20 mol %, more preferably 0.3 to 15 mol %, and most preferably 1 to 10 mol %.

An iodide ion amount exceeding 20 mol % is unpreferable because the rate of development is generally lowered.

When iodine atoms are to be released in the form of iodide ions from the iodide ion-releasing agent, iodine atoms may be either released completely or partially left undecomposed.

The rate at which iodide ions are released from the iodide ion-releasing agent will be described below by way of practical examples.

In the present invention, it is preferable to form a silver halide phase containing silver iodide on the edges of a tabular grain while iodide ions are rapidly being generated during the process of introducing dislocation lines into the tabular grain, in order to introduce dislocation lines at a high density. If the supply rate of iodide ions is too low, i.e., if the time required to form a silver halide phase containing silver iodide is too long, the silver halide phase containing silver iodide dissolves again during the formation, and the dislocation density decreases. On the other hand, supplying iodide ions slowly is preferable in performing grain formation such that no nonuniformity is produced in a distribution of dislocations between individual grains.

It is therefore important that iodide ions be rapidly generated without causing any locality (nonuniform distribution). When an iodide ion-releasing agent or an iodide ion release-controlling agent to be used together therewith is added through an inlet to a reaction solution placed in a grain formation vessel, a locality with a high concentration of added agent may be formed near the inlet. Thus, correspondingly, a locality of generated iodide ions is produced, since an iodide ion release reaction proceeds very quickly.

The rate at which iodide ions released is deposited on a host grain is very high, and grain growth occurs in a region near the addition inlet where the locality of the iodide ions is large. The result is grain growth nonuniform between individual grains.

Therefore, the iodide ion-releasing rate must be selected so as not to cause locality of iodide ions.

In conventional methods (e.g., a method of adding an aqueous potassium iodide solution), iodide ions are added in a free state even when an aqueous potassium iodide solution is diluted before the addition. This limits the reduction in locality of iodide ions. That is, it is difficult for the conventional methods to perform grain formation without causing nonuniformity between grains. The present invention, however, which can control the iodide ion-releasing rate, makes it possible to reduce the locality of iodide ions compared to the conventional methods.

In the example described above, dislocation lines can be introduced at a high density and uniformly between individual grains compared to the conventional methods by the use of the present invention capable of performing grain formation while producing iodide ions rapidly without causing any locality.

In the present invention, the iodide ion-releasing rate can be determined by controlling the temperature and the concentrations of the iodide ion-releasing agent and the iodide ion release-controlling agent and therefore can be selected in accordance with the intended use.

In the present invention, a preferable iodide ion-releasing rate is the one at which 50 to 100% of the total weight of the iodide ion-releasing agent present in a reaction solution in a grain formation vessel complete release of iodide ion within 180 consecutive seconds, more preferably within 120 consecutive seconds, and most preferably within 60 consecutive seconds.

Preferably, the iodide ions should be released over at least 1 second.

In the present invention, the words "180 consecutive seconds" means 180 second for which the reaction of releasing iodide ions continues. The iodide ion-releasing time may be measured, starting at any time during the continuous reaction.

If the iodide ions are released during two or more periods, set part from one another, the iodide ion releasing period may be measured, starting at any time during the first period or any other period. The ion releasing rate may be determined at said time during the first period or any other period. A releasing rate at which the time exceeds 180 seconds is generally low, and a releasing rate at which the time exceeds less than 1 second is generally low. The releasing rate is limited. This similarly applied to a releasing rate at which the amount of the iodide ion-releasing agent is less than 50%.

"Completion of release of iodide ions" means that all the iodine contained in a particular iodide ionreleasing agent is released from the releasing agent in the form of ions. For example, in the case of an iodide ion-releasing agent having one iodine in the molecule, the release of iodide ions is completed when the one iodine is released from the releasing agent. In the case of an iodine ion-releasing agent having two or more iodines in the molecule, the release of iodide ions is completed when all of the two or more iodines are released therefrom.

A more preferable rate is the one at which 100 to 70% of the iodide ion-releasing agent present in a reaction solution in a grain formation vessel complete release of iodide ion within 180 consecutive seconds. The rate is further preferably the one at which 100 to 80%, and most preferably 100 to 90% complete release of iodide ion within 180 consecutive seconds.

When the reaction of rapidly producing iodide ions is represented by a second-order reaction essentially proportional to the concentration of the iodide ion-releasing agent and that of the iodide ion release-controlling agent (under water, 40° C.), the rate constant of the second-order reaction in the present invention is preferably 1,000 to $5\times10^{-3}$ $M^{-1}.sec^{-1}$, more preferably 100 to $5\times10^{-2}$ $M^{-1}.sec^{-1}$, and most preferably 10 to 0.1 $M^{-1}.sec^{-1}$.

The "second-order reaction" means essentially that the coefficient of correlation is 1.0 to 0.8. The following is representative examples of a second-order reaction rate constant k $M^{-1}.sec^{-1}$ measured under the conditions considered to be a pseudo first-order reaction: the concentration of the iodide ion-releasing agent ranging from $10^{-4}$ to $10^{-5}$M, the concentration of the iodide ion release control agent ranging from $10^{-1}$ to $10^{-4}$M, under water, and 40° C.

| Compound No. | Iodide ion release-controlling agent | k |
|---|---|---|
| 11 | Hydroxide ion | 1.3 |
| 1 | Sulfite ion | $1\times10^{-3}$ or less |
| 2 | " | 0.29 |
| 58 | " | 0.49 |
| 63 | " | 1.5 |
| 22 | Hydroxide ion | 720 |

If k exceeds 1,000, the release is too fast to control; if it is less than $5\times10^{-3}$, the release is too slow to obtain the effect of the present invention. The following method is favorable to control the release of iodide ions in the present invention. That is, this method allows the iodide ion-releasing agent, added to a reaction solution in a grain formation vessel and already distributed uniformly, to release iodide ions uniformly throughout the reaction solution by changing the pH, the concentration of a nucleophilic substance, or the temperature, normally by changing from a low pH to a high pH.

It is preferable that alkali for increasing the pH during release of iodide ions and the nucleophilic substance be added in a condition in which the iodide ion-releasing agent is distributed uniformly throughout the reaction solution.

More specifically, in the present invention, iodide ions, which are to react with silver ions, are rapidly generated in a reaction system in order to form silver halide grains containing silver iodide (e.g., silver iodide, silver bromoiodide, silver bromochloroiodide, or silver chloroiodide). In most cases, the iodide ion-releasing agent of the present invention is added, if necessary along with another halogen ion source (e.g., KBr), to the reaction system which uses, as a reaction medium, an aqueous gelatin solution containing silver ions due to addition of, for example, silver nitrate, or containing silver halide grains (e.g., silver bromolodide grains), and the iodide ion-releasing agent is distributed uniformly in the reaction system by a known method (by, e.g., stirring). At this point, the pH of the reaction system normally exhibits a weak acidity. In this state, the iodide ion-releasing agent does not release iodide ions rapidly.

An alkali (e.g., sodium hydroxide or sodium sulfite) is then added, as an iodide ion release-controlling agent, to the reaction system, thereby increasing the pH of the system to the alkaline side (preferably, 7.5 to 10). As a result, iodide ions are rapidly released from the iodide ion-releasing agent. The iodide ions react with the silver ions or undergo halogen conversion with the silver halide grains, thus forming a silver iodide-containing region.

As has been indicated, the reaction temperature usually ranges from 30° to 80° C., more preferably 35° to 75° C., and most preferably 35° to 60° C. The iodide ion-releasing agent releases iodide ions usually at such a rate that 50 to 100% of the agent completes release of iodide ions within a consecutive period of more than 1 second within 180 seconds immediately after the time of adding the alkali. To make the iodide ion-releasing agent to release iodide ions at such a rate, which iodide ion-releasing agent and which iodide ion release control agent should be used in combination in which amounts they should be used are determined in accordance with the second-order reaction rate constant described above.

In order to distribute the alkali uniformly in the reaction system (that is, to produce silver iodide uniformly), it is desirable that the alkali be added while the reaction system is being vigorously stirred (in accordance with, for example, controlled double jet method).

Emulsions of the present invention and other emulsions used together with the emulsions of the present invention will be described below.

The silver halide grain for use in the present invention consists of silver bromide, silver chloride, silver iodide, silver chlorobromide, silver iodochloride, silver bromoiodide, or silver bromochloroiodide. The silver halide grain may contain another silver salt, such as silver rhodanate, silver sulfide, silver selehide, silver carbonate, silver phosphate, or an organic acid silver, as another grain or as a portion of the grain.

The silver halide emulsion of the present invention preferably has a distribution or a structure associated with a halogen composition in its grains. A typical example of such a grain is a core-shell or double structure grain having different halogen compositions in its interior and surface layer as disclosed in, e.g., JP-B-43-13162, JP-A-61-215540, JP-A-60-222845, JP-A-60-143331, or JP-A-61-75337. The structure need not be a simple double structure but may be a triple structure or a multiple structure larger than the triple structure as disclosed in JP-A-60-222844. It is also possible to bond a thin silver halide having a different composition from that of a core-shell double-structure grain on the surface of the grain.

The structure to be formed inside a grain need not be the surrounding structure as described above but may be a so-called junctioned structure. Examples of the junctioned structure are disclosed in JP-A-59-133540, JP-A-58-108526, EP 199,290A2, JP-B-58-24772, and JP-A-59-16254. A crystal to be junctioned can be formed on the edge, the corner, or the face of a host crystal to have a different composition from that of the host crystal. Such a junctioned crystal can be formed regardless of whether a host crystal is uniform in halogen composition or has a core-shell structure.

In the case of the junctioned structure, it is naturally possible to use a combination of silver 10 halides. However, it is also possible to form the junctioned structure by combining a silver halide and a silver salt compound not having a rock salt structure, such as silver rhodanate or silver carbonate. In addition, a non-silver salt compound, such as lead oxide, can also be used provided that formation of the junctioned structure is possible.

In a silver bromoiodide grain having any of the above structures, it is preferable that the silver iodide content in a core portion be higher than that in a shell portion. In contrast, it is sometimes preferable that the silver iodide content in the core portion be low and that in the shell portion be high. Similarly, in a junctioned-structure grain, the silver iodide content may be high in a host crystal and low in a junctioned crystal and vice versa. The boundary portion between different halogen compositions in a grain having any of the above structures may be either definite or indefinite. It is also possible to positively form a continuous composition change.

In a silver halide grain in which two or more silver halides are present as a mixed crystal or with a structure, it is important to control the distribution of halogen compositions between grains. A method of measuring the distribution of halogen compositions between grains is described in JP-A-60-254032. A uniform halogen distribution between grains is a desirable characteristic. In particular, a highly uniform emulsion having a variation coefficient of 20% or less is preferable. An emulsion having a correlation between a grain size and a halogen composition is also preferable. An example of the correlation is that larger grains have higher iodide contents and smaller grains have lower iodide contents. An opposite correlation or a correlation with respect to another halogen composition can also be selected in accordance with the intended use. For this purpose, it is preferable to mix two or more emulsions having different compositions.

It is important to control the halogen composition near the surface of a grain. Increasing the silver iodide content or the silver chloride content near the surface can be selected in accordance with the intended use because this changes a dye adsorbing property or a developing rate. In order to change the halogen composition near the surface, it is possible to use either the structure in which a grain is entirely surrounded by a silver halide or the structure in which a silver halide is adhered to only a portion of a grain. For example, a halogen composition of only one of a (100) face and a (111) face of a tetradecahedral grain may be changed, or a halogen composition of one of a major face or a side face of a tabular grain may be changed.

Silver halide grains for use in the emulsions of the present invention and emulsions to be used together with the emulsions of the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4,865,964. So this method can be used as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842. It is also possible to use, in accordance with the intended use of an emulsion, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, vol. 30, page 247, 1986, although the preparation method requires some elaborations. A grain having two or more different faces, such as a tetradecahedral grain having both (100) and (111) faces, a grain having (100) and (110) faces, or a grain having (111) and (110) faces can also be used in accordance with the intended use of an emulsion.

A value obtained by dividing the equivalent-circle diameter of the projected area of a grain by the thickness of that grain is called an aspect ratio that defines the shape of a tabular grain. Tabular grains having aspect ratios higher than 1 can be used in the present invention. Tabular grains can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048 and 4,439,520, and British Patent 2,112,157. The use of tabular grains brings about advantages, such as an increase in covering power and an increase in spectral sensitization efficiency due to sensitizing dyes. These advantages are described in detail in U.S. Pat. No. 4,434,226 cited above. An average aspect ratio of 80% or more of a total projected area of grains is preferably 1 to 100, more preferably 2 to 30, and most preferably 3 to 25.

To take advantage of the maximum merit of tabular grains, an emulsion with an average aspect ratio of 1 or more is preferred. However, an average aspect ratio greater than 100 is unpreferred because a resistance to pressure is degraded.

The shape of a tabular grain can be selected from, e.g., a triangle, a hexagon, and a circle. An example of a preferable shape is a regular hexagon having six substantially equal sides, as described in U.S. Pat. No. 4,797,354.

The equivalent-circle diameter of the tabular grains is preferably 0.15 to 5.0 μm.

The thickness of the tabular grains is preferably 0.05 to 1.0 μm.

A thickness smaller than 0.05 μm is unpreferred because a resistance to pressure is lowered. A thickness larger than 1.0 μm is also unpreferred because it is impossible to make the best use of the merit of the tabular grains.

As for the ratio occupied by the tabular grains, tabular grains with an aspect ratio of 3 or more occupy preferably 50% or more, more preferably 80% or more, and most preferably 90% or more of the total projected area.

It is sometimes possible to obtain more favorable effects by using monodisperse tabular grains. The structure and the method of manufacturing monodisperse tabular grains are described in, e.g., JP-A-63-151618. The shape of the grains will be briefly described below. That is, 70% or more of the total projected area of silver halide grains are accounted for by a hexagonal tabular silver halide, in which the ratio of an edge having the maximum length to the length of an edge having the minimum length is 2 or less, and which has two parallel faces as outer surfaces. In addition, the grains have monodispersibility by which the variation coefficient of the grain size distribution of these hexagonal tabular silver halide grains (i.e., a value obtained by dividing a variation (standard deviation) in grain sizes, which are represented by the equivalent-circle diameters of the projected areas of grains, by their average grain size) is 20% or less.

The use of grains having dislocation lines is also favorable.

Dislocation lines of a tabular grain can be observed by using a transmission electron microscope. It is preferable to select a grain containing no dislocations, a grain containing several dislocation lines, or a grain containing a large number of dislocation lines in accordance with the intended use. It is also possible to select dislocation lines introduced linearly with respect to a specific direction of a crystal orientation of a grain or dislocation lines curved with respect to that direction. Alternatively, it is possible to selectively introduce dislocation lines throughout an entire grain or only to a particular portion of a grain, e.g., the fringe portion of a grain. Introduction of dislocation lines is preferable not only for tabular grains but for a regular crystal grain or an irregular grain represented by a potato-like grain. Also in this case, it is preferable to limit the positions of dislocation lines to specific portions, such as the corners or the edges, of a grain.

A silver halide emulsion used in the present invention may be subjected to a treatment for rounding grains, as disclosed in EP 96,727B1 or EP 64,412B1, or surface modification, as disclosed in West German Patent 2,306,447C2 or JP-A-60-221320.

Although a flat grain surface is common, intentionally forming projections and recesses on the surface is preferable in some cases. Examples are a methods described in JP-A-58-106532 and JP-A-60-221320, in which a hole is formed in a portion of a crystal, e.g., the corner or the center of the face of a crystal, and a ruffle grain described in U.S. Pat. No. 4,643,966.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of the grain, or the equivalent-sphere diameter of the volume of a grain obtained by a Coulter counter method. It is possible to selectively use various grains from a very fine grain having an equivalent-sphere diameter of 0.05 μm or less to a large grain having that of 10 μm or 10 more. It is preferable to use a grain having an equivalent-sphere diameter of 0.1 to 3 μm as a light-sensitive silver halide grain.

In the present invention, it is possible to use a so-called polydisperse emulsion having a wide grain size distribution or a monodisperse emulsion having a narrow grain size distribution in accordance with the intended use. As a measure representing the size distribution, a variation coefficient of either the equivalent-circle diameter of the projected area of a grain or the equivalent-sphere diameter of the volume of a grain is sometimes used. When a monodisperse emulsion is to be used, it is desirable to use an emulsion having a size distribution with a variation coefficient of preferably 25% or less, more preferably 20% or less, and most preferably 15% or less.

The monodisperse emulsion is sometimes defined as an emulsion having a grain size distribution in which 80% or more of all grains fall within a range of ±30% of an average grain size represented by the number or the weight of grains. In order for a light-sensitive material to satisfy its target gradation, two or more monodisperse silver halide emulsions having different grain sizes can be mixed in the same emulsion layer or coated as different layers in an emulsion layer having essentially the same color sensitivity. It is also possible to mix, or coat as different layers, two or more types of polydisperse silver halide emulsions or monodisperse emulsions together with polydisperse emulsions.

Photographic emulsions used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-Jet method) of forming grains in the presence of excess silver ion. As one type of the double-Jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, EP 273,429 and EP 273,430, and West German Patent 3,819,241. This method is an effective grain formation method. To convert into a silver salt that is more sparingly soluble, it is possible to add a solution of a soluble halogen salt or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650 and 3,785,777, and West German Patents 2,556,885 and 2,555,364.

A silver halide solvent is useful for the purpose of accelerating ripening. As an example, it is known to make an excess of halogen ions exist in a reactor vessel in order to accelerate ripening. Another ripening agent can also be used. The total amount of these ripening agents can be mixed in a dispersing medium placed in a reactor vessel before addition of silver and halide salts, or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130 and 4,782,013, and JP-A-57-104926), a thione compound (e.g., tetra-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a cellulose derivative such as hydroxyethylcellulose, carboxymethylcellulose, and cellulose sulfates, a sugar derivative, such as sodium alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion used in the present invention for a desalting purpose and disperse it in a newly prepared protective colloid. Although the temperature of washing can be selected in accordance with the intended use, it is preferably 5° C. to 50° C. Although the pH at washing can also be selected in accordance with the intended use, it is preferably 2 to 10, and more preferably 3 to 8. The pAg at washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion used in the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in modifying the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, It, Pt, Au, Cd, Hg, Ti, In, Sn, Pb, and Bi. These metals can be added as long as they are in the form of a salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in water or an appropriate organic solvent, such as methanol or acetone, and added in the form of a solution. To stabilize the solution, an aqueous hydrogen halide solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In formation of silver halide grains of the present invention, at least one of sulfur sensitization, selenium sensitization, gold sensitization, palladium sensitization or noble metal sensitization, and reduction sensitization can be performed at any point during the process of manufacturing a silver halide emulsion. The use of two or more different sensitizing methods is preferred. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$, and more preferably $1\times10^{-5}$ to $5\times10^{-7}$ mol per mol of silver halide. A preferable amount of a palladium compound is $1\times10^{-3}$ to $5\times10^{-7}$ mol per mol of silver halide. A preferable amount of a thiocyan compound or a selenocyan compound is $5\times10^{-2}$ to $1\times10^{-6}$ mol per mol of silver halide.

An amount of a sulfur sensitizer with respect to silver halide grains of the present invention is preferably $1\times10^{-4}$ to $1\times10^{-7}$ mol, and more preferably $1\times10^{-5}$ to $5\times10^{-7}$ mol per mol of silver halide.

Selenium sensitization is a favorable sensitizing method for the emulsions of the present invention. Known unstable selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of a silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions used in the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt hardly soluble in water, such as a silver halide, silver sulfide, or silver selenide, or a silver salt readily soluble in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O_2$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers are an inorganic oxidizer such as ozone, hydrogen peroxide and its adduct, a halogen element, on a thiosulfonate, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be performed during grain formation or chemical sensitization.

Photographic emulsions used in the present invention may contain various compounds in order to prevent fog during the manufacturing process, storage, or photographic processing of a light-sensitive material, or to stabilize photographic properties. Usable compounds are those known as an antifoggant or a stabilizer, for example, thiazoles, such as benzothiazolium salt; nitroimidazoles; nitrobenzimidazoles; chlorobenzimidazoles; bromobenzimidazoles; mercaptothiazoles; mercaptobenzothiazoles; mecaptobenzimidazoles; mercaptothiadiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be contained in these dyes. Examples of a nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei may have a substituent on a carbon atom.

It is possible for a merocyanine dye or a composite merocyanine dye to have a 5- or 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618, and JP-A-52-109925.

Emulsions may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount may be $4\times10^{-6}$ to $8\times10^{-3}$ mol per mole of a silver halide. However, for a more preferable silver halide grain size of 0.2 to 1.2 μm, an addition amount of about $5\times10^{-5}$ to $2\times10^{-3}$ mol per mole of silver halide is effective.

In the light-sensitive material prepared by using the silver halide emulsions obtained in the present invention, at least one of blue-, green-, and red-sensitive silver halide emulsion layers need only be formed on a support, and the number and order of the silver halide emulsion layers and non-light-sensitive layers are not particularly limited. A typical example is a silver halide photographic light-sensitive material having, on its support, at least one light-sensitive layer constituted by a plurality of silver halide emulsion layers which are sensitive to essentially the same color but have different sensitivities. This light-sensitive layer is a unit sensitive layer which is sensitive to one of blue light, green light, and red light. In a multilayered silver halide color photographic light-sensitive material, such unit light-sensitive layers are generally arranged in an order of red-, green-, and blue-sensitive layers from a support. However, according to the intended use, this arrangement order may be reversed, or light-sensitive layers sensitive to the same color may sandwich another light-sensitive layer sensitive to a different color.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity is sequentially decreased toward a support, and a non-light-sensitive layer may be formed between the respective silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed 10 red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-speed emulsion layer from the farthest side from a support in a layer sensitive to one color as described in JP-A-59-202464.

In addition, an order of high-speed emulsion layer/low-speed emulsion layer/medium-speed emulsion layer or low-speed emulsion layer/medium-speed emulsion layer/high-speed emulsion layer may be adopted.

Furthermore, the arrangement can be changed as described above even when four or more layers are formed.

Although the several different additives described above can be used in the light-sensitive material according to the present invention, a variety of other additives can also be used in accordance with the intended use.

The details of these additives are described in Research Disclosures Item 17643 (December, 1978), Item 18716 (November, 1979), and Item 308119 (December, 1989), and these portions are summarized in Table 1 below.

TABLE 1

| Additives | RD17643 | RD18716 | RD308119 |
|---|---|---|---|
| 1. Chemical sensitizers | page 23 | page 648, right column | page 996 |
| 2. Sensitivity increasing agent | | page 648, right column | |
| 3. Spectral sensitizers, super sensitizers | pages 23–24 | page 648, right column to page 649, right column | page 996, right column to page 998, right column |
| 4. Brighteners | page 24 | | page 998, right column |
| 5. Antifoggants and stabilizers | pages 24–25 | page 649, right column | page 998, right column to page 1,000, right column |
| 6. Light absorbent, filter dye, ultraviolet absorbents | pages 25–26 | page 649, right column to page 650, left column | pages 1,000, left column to page 1,0003, right column |
| 7. Stain preventing agents | page 25, right column | page 650, left to right columns | page 1,002, right column |
| 8. dye image stabilizer | page 25 | | page 1,002, right column |
| 9. Hardening agents | page 26 | page 651, left column | page 1,004, right column to page 1,005, left column |
| 10. Binder | page 26 | page 651, left column | page 1,003, right column to page 1,004, right column |
| 11. Plasticizers, lubricants | page 27 | page 650, right column | page 1,006, left to right column |
| 12. Coating aids, surface active agents | pages 26–27 | page 650, right column | pages 1,005, left to right column |
| 13. Antistatic agents | page 27 | page 650, right column | page 1,006, right column to page 1,007, left column |
| 14. Matting agents | | | page 1,008, left column to page 1,009, left column |

In addition, in order to prevent deterioration in photographic properties caused by formaldehyde gas, the light-sensitive material is preferably added with a compound described in U.S. Pat. No. 4,411,987 or 4,435,503, which can react with formaldehyde to fix it.

Various color couplers can be used in the present invention, and specific examples of these couplers are described in patents described in above-mentioned Research Disclosure No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,565,630, and WO No. 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Application (OLS) No. 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,221, 4,367,288, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator are described in British Patents 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with an oxidized form of a developing agent.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11,449 and 24,241 and JP-A-61-201247; a ligand releasing coupler described in, e.g., U.S. Pat. No. 4,553,477; a coupler which releases a leuco dye described in JP-A-63-75747; and a coupler which releases a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, e.g., U.S. Pat. No. 2,322,027.

Examples of a high-boiling organic solvent to be used in the oil-in-water dispersion method and having a boiling point of 175° C. or more at atmospheric pressure are phthalic esters (e.g., dibutylphthalate, dicyclohexyl phthalate, di-2-ethylhexylphthalate, decylphthalate, bis(2,4-di-t-amylphenyl)phthalate, bis(2,4-di-t-amylphenyl)isophthalate, and bis(1,1-di-ethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of an impregnating latex are described in, e.g., U.S. Pat. No. 4,199,363 and West German Patent Application (OLS) Nos. 2,541,274 and 2,541,230.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper. The present invention can also be particularly preferably applied to a color duplicate film.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the total film thickness of all hydrophilic colloid layers on the side having emulsion layers is preferably 28 μm or less, more preferably 23 μm or less, particularly preferably 18 μm or less, and most preferably 16 μm or less. A film swell speed $T_{1/2}$ is preferably 30 sec. or less, and more preferably, 20 sec. or less. In this case, the film thickness means the thickness of a film measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, page 615, the left to right columns, and RD No. 307105, pp. 880 and 881.

A color developer used in development of the light-sensitive material of the present invention is preferably an aqueous alkaline solution mainly consisting of an aromatic primary amine-based color developing agent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Of these compounds, 3-methyl-4-amino-N-ethyl-N-β-hydroxyethylaniline sulfate is most preferred. These compounds can be used in a combination of two or more thereof in accordance with the application.

In general, the color developer contains a Ph buffering agent such as a carbonate, a borate, or a phosphate of an alkali metal, and a development restrainer or an antifoggant such as a bromide, an iodide, a benzimidazole, a benzothiazole, or a mercapto compound. If necessary, the color developer may also contain a preservative such as hydroxylamine, diethylhydroxylamine, a hydrazine sulfite, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenyl such as N-methyl-p-aminophenol can be used singly or in a combination of two or more thereof. The pH of the color and black-and-white developers is generally 9 to 12. Although the quantity of replenisher of these developers depends on a color photographic light-sensitive material to be processed, it is generally 3 liters or less per $m^2$ of the light-sensitive material. The quantity of replenisher can be decreased to be 500 ml or less by decreasing a bromide ion concentration in the replenisher. In order to decrease the quantity of replenisher, a contact area of a processing tank with air is preferably decreased to prevent evaporation and oxidation of the replenisher upon contact with air.

A contact area of a photographic processing solution with air in a processing tank can be represented by an aperture defined below:

$$\text{Aperture} = [\text{contact area } (cm^2) \text{ of processing solution with air}] + [\text{volume } (cm^3) \text{ of processing solution}]$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally two to five minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, according to the intended use. Examples of the bleaching agent are a compound of a multivalent metal such as iron(III), peroxides, quinones, and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-104232, JP-A-53-124424, and JP-A-53-141623, and JP-A-53-28426, and Research Disclosure No. 17,129 (July, 1978); a thiazolidine derivative described in JP-A-50-140129; iodide salts described in JP-B-45-8506, JP-A-52-20832, JP-A-53-32735, U.S. Pat. No. 3,706,561, and JP-A-58-16235; polyoxyethylene compounds descried in West German Patents 977,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294, 769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleachfixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the intended use of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248– 253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. Various chelating agents or antifungal agents can be added in the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoanilinebased compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

The silver halide color photographic lightsensitive material of the present invention can achieve its effects more easily when applied to film units with lenses described in JP-B-2-32615 and Published Examined Japanese Utility Model Application No. 3-39784.

The present invention will be described in greater detail below by way of its examples, but the invention is not limited to these examples.

EXAMPLE 1

Tabular Silver Bromolodide Emulsion (1) Preparation of Emulsions <Tabular silver bromoiodide emulsion 1-A>(comparative emulsion)

(Process a) While 1,200 cc of an aqueous solution containing 6.2 g of gelatin and 6.4 g of KBr were stirred at 60° C., 8 cc of an aqueous 1.9 mol $AgNO_3$ solution and 9.6 cc of an aqueous 1.7 mol KBr solution were added to the solution by a double-Jet method over 45 seconds. After 38g of gelatin were added to the resultant solution, the solution was heated up to 75° C. and ripened in the presence of $NH_3$ for 20 minutes. The resultant solution was neutralized with $HNO_3$, and 405 cc of an aqueous 1.9 mol $AgNO_3$ solution and an aqueous 1.9 mol KBr solution containing 1 mol % of KI were added to the solution with the pAg kept at 8.22 while the flow rate was accelerated (such that the final flow rate was 10 times that at the beginning) over 87 minutes.

(Process b) Thereafter, the temperature was decreased to 55° C., and 80 cc of an aqueous 0.3 mol KI solution were added to the resultant solution at a predetermined flow rate over one minute. Subsequently, 206 cc of an aqueous 1.9 mol $AgNO_3$ solution and 200 cc of an aqueous 2.0 mol KBr solution were added to the solution at predetermined flow rates over 26 minutes.

Thereafter, the resultant emulsion was cooled to 35° C. and washed by a conventional flocculation method. 46 g of gelatin were added to the resultant emulsion, and the pH and the pAg of the emulsion were adjusted to 5.5 and 8.2, respectively. The obtained grains were found to be tabular grains having an average equivalent-sphere diameter of 1.3 μm.

This was the same with the following tabular emulsions.

<Tabular silver iodobromide emulsion 1-B>(comparative emulsion)

A tabular silver iodobromide emulsion 1-B was prepared following the same procedures as for the emulsion 1-A except the following.

In the process a, while 1,200 ml of an aqueous solution containing 6.2g of gelatin and 6.4g of KBr were stirred with the temperature kept at 30° C., instead of 60° C., 14.4 cc of an aqueous 1.0 mol $AgNO_3$ solution and 7.5 cc of an aqueous 2.0 mol KBr solution were simultaneously added to the solution by the double-jet method over 30 seconds, instead of 45 seconds.

In addition, in place of the ripening performed in the presence of $NH_3$ at 75° C. for 20 minutes, physical ripening was performed in the absence of $NH_3$ for 20 minutes.

In the process b, an aqueous 0.3 mol KI solution was added in an amount of 126 cc, instead of 80 cc, at a predetermined flow rate over one minute.

<Tabular silver iodobromide emulsion 1-C>(comparative emulsion)

A tabular silver iodobromide emulsion 1-C was prepared following the same procedures as for the emulsion 1-B except the following.

In the process a, 48 cc of an aqueous 0.1 mol $AgNO_3$ solution and 25 cc of an aqueous 0.2 mol KBr solution were added simultaneously by the double-jet method over 10 seconds in place of 14.4 cc of the aqueous 1.0 mol $AgNO_3$ solution and 7.5 cc of the aqueous 2.0 mol KBr solution, respectively.

In the process b, the aqueous 0.3 mol KI solution was added in an amount of 171 cc, instead of 80 cc, at a predetermined flow rate over one minute.

<Tabular silver iodobromide emulsion 1-D>(comparative emulsion)

A tabular silver iodobromide emulsion 1-D was prepared following the same procedures as for the emulsion 1-C except the following.

In the process b, the aqueous 0.3 mol KI solution was added in an amount of 210 cc, instead of 171 cc, at a predetermined flow rate over one minute.

<Tabular silver iodobromide emulsion 1-E>(comparative emulsion)

A tabular silver iodobromide emulsion 1-E was prepared following the same procedures as for the emulsion 1-A except the following.

In the process b, instead of the addition of 80 cc of the aqueous 0.3 mol KI solution at a predetermined flow rate over one minute, an aqueous sodium p-iodoacetamidobenzenesulfonate (9.2 g) solution was added, and 36 cc of an aqueous 0.8 mol sodium sulfite solution were added to the resultant solution at a predetermined flow rate over one minute. Thereafter, the pH was kept at 9.0 for eight minutes to rapidly generate iodide ions, and then returned to 5.6. (50% of the sodium p-iodoacetamidobenzenesulfonate added was caused to release iodide ions for 10 seconds after the pH was raised to 9.0.)

<Tabular silver iodobromide emulsion 1-F>(emulsion of the present invention)

A tabular silver iodobromide emulsion 1-F was prepared following the same procedures as for the emulsion 1-B except the following.

In the process b, instead of the addition of 126 cc of the aqueous 0.3 mol KI solution at a predetermined flow rate over one minute, 630 cc of an aqueous 0.06 mol KI solution were added at a predetermined flow rate over one minute.

<Tabular silver iodobromide emulsion i-G>(emulsion of the present invention)

A tabular silver iodobromide emulsion 1-G was prepared following the same procedures as for the emulsion 1-B except the following.

In the process b, instead of the addition of 126 cc of the aqueous 0.3 mol KI solution at a predetermined flow rate over one minute, an aqueous sodium p-iodoacetamidobenzenesulfonate (14.2 g) solution was added, and 55 cc of an aqueous 0.8 mol sodium sulfite solution were added to the resultant solution at a predetermined flow rate over one minute. Thereafter, the pH was kept at 9.0 for eight minutes to rapidly generate iodide ions, and then returned to 5.6. (50% of the sodium p-iodoacetamidobenzenesulfonate added was caused to release iodide ions for six seconds after the pH was raised to 9.0.)

<Tabular silver iodobromide emulsion 1-H>(emulsion of the present invention)

A tabular silver iodobromide emulsion 1-H was prepared following the same procedures as for the emulsion 1-C except the following.

In the process b, instead of the addition of 171 cc of the aqueous 0.3 mol KI solution at a predetermined flow rate over one minute, an aqueous sodium p-iodoacetamidobenzenesulfonate (19.3 g) solution was added, and 75 cc of an aqueous 0.8 mol sodium sulfite solution were added to the resultant solution at a predetermined rate over one minute. Thereafter, the pH was kept at 9.0 for eight minutes to rapidly generate iodide ions, and then returned to 5.6. (50% of the sodium p-iodoacetamidobenzenesulfonate added was caused to release iodide ions for four seconds after the pH was raised to 9.0.)

<Tabular silver iodobromide emulsion 1-I>(emulsion of the present invention)

A tabular silver iodobromide emulsion 1-I was prepared following the same procedures as for the emulsion 1-H except the following.

In the process a, an aqueous $AgNO_3$ solution and an aqueous KBr solution were added over 87 minutes while the pAg was kept at 8.29 instead of 8.22 and the flow rates were accelerated.

In the emulsions of the present invention, the iodide ion release rate was obtained as follows. That is, emulsion grains were separated by centrifugal separation, and an amount of an unreacted iodide ion-releasing agent contained in the resultant supernatant liquid was determined by ICP (Inductively Coupled Plasma) spectrometry. The iodide ion release rate was calculated from the obtained change with time.

(2) Chemical Sensitization

The emulsions 1-A to 1-I were subjected to chemical sensitization as follows at 60° C., pH 6.20, and pAg 8.40.

First, $1.6\times10^{-3}$ mol/molAg of a sensitizing dye presented below was added.

Subsequently, potassium thiocyanate, potassium chloroaurate, sodium thiosulfate, and a selenium sensitizer presented below were added in amounts of $3.0\times10^{-3}$ mol/molAg, $6\times10^{-6}$ mol/molAg, $1\times10^{-5}$ mol/molAg, and $3\times10^{-6}$ mol per mol of silver halide, respectively, and ripening was performed at 60° C. such that the highest sensitivity could be obtained when exposure was performed for 1/100 second.

Sensitizing dye

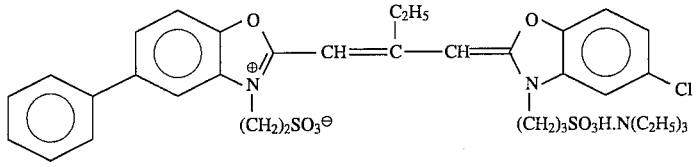

Selenium sensitizing dye

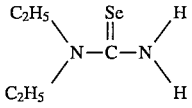

(3) Making and evaluation of coated samples

The emulsion and protective layers listed in Table 1 (to be presented later) were coated in amounts listed in Table A on cellulose triacetate film supports having undercoat layers, thereby making coated samples 1 to 9.

TABLE A

| Emulsion coating conditions | |
|---|---|
| (1) Emulsion layer | |
| Emulsion . . . several different emulsions | (silver $3.6\times10^{-2}$ mol/m$^2$) |
| Coupler | ($1.5\times10^{-3}$ mol/m$^2$) |

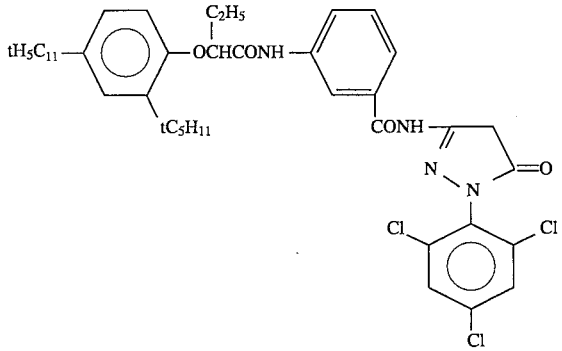

| | |
|---|---|
| Tricresylphosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours, exposed through a continuous wedge for 1/100 second, and subjected to color development shown in Table B below.

The densities of the samples thus processed were measured through a green filter.

TABLE B

| Process | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The compositions of the individual processing solutions are given below.

| | (g) |
|---|---|
| (Color developing solution) | |
| Diethylenetriaminepentaacetate | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 l |
| pH | 10.05 |
| (Bleach-fixing solution) | |
| Ferric ammonium ethylenediamine-tetraacetate dihydrate | 90.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |
| Bleaching accelerator | 0.01 mol |

-continued

| | (g) |
|---|---|
| 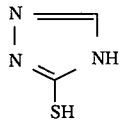 | |
| Water to make | 1.0 l |
| pH | 6.0 |

(Washing solution) Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added.

The pH of the solution ranged from 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |
| pH | 5.0–8.0 |

The sensitivity is represented by a relative value of the logarithm of the reciprocal of an exposure amount (lux.sec) by which a density of fog+0.2 is given.

The results are summarized in Table 1 below.

TABLE 1

| Sample No. | Emulsion name | Average aspect ratio of all tabular grains | Variation coefficient of equivalent-circuit diameters of projected area of all grains | Projected area occupied by hexagonal tabular grains | Iodide ion supply source |
|---|---|---|---|---|---|
| 1 | 1-A | 7 | 13 (%) | 85 (%) | KI |
| 2 | 1-B | 11 | 16 | 90 | KI |
| 3 | 1-C | 15 | 18 | 88 | KI |
| 4 | 1-D | 15 | 18 | 88 | KI |
| 5 | 1-E | 7 | 13 | 85 | 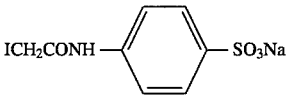 ($Na_2SO_3$ also was used) |
| 6 | 1-F | 11 | 16 | 90 | KI |
| 7 | 1-G | 11 | 16 | 90 | 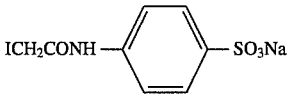 ($Na_2SO_3$ also was used) |
| 8 | 1-H | 15 | 18 | 88 | 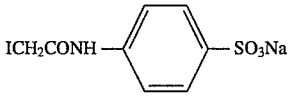 ($Na_2SO_3$ also was used) |

TABLE 1-continued

| | | | | | |
|---|---|---|---|---|---|
| 9 | 1-I | 15 | 20 | 87 | 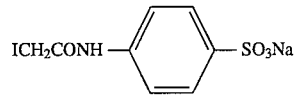 ($Na_2SO_3$ also was used) |

| Sample No. | Ratio of grains with silver iodide content of 0.7I to 1.3I (I is average silver iodide content) | Ratio of grains having 10 or more dislocations | Fog | Sensitivity | Remarks |
|---|---|---|---|---|---|
| 1 | 66 (%) (I = 2.2 mol %) | 79 (%) | 0.33 | 100 | Comparative example |
| 2 | 49 (I = 3.4 mol %) | 48 | 0.41 | 105 | Comparative example |
| 3 | 47 (I = 4.0 mol %) | 43 | 0.42 | 112 | Comparative example |
| 4 | 48 (I = 5.8 mol %) | 53 | 0.40 | 110 | Comparative example |
| 5 | 97 (I = 2.1 mol %) | 98 | 0.25 | 115 | Comparative example |
| 6 | 64 (I = 3.4 mol %) | 65 | 0.27 | 120 | Present invention |
| 7 | 86 (I = 3.2 mol %) | 85 | 0.27 | 126 | Present invention |
| 8 | 77 (I = 4.3 mol %) | 73 | 0.26 | 162 | Present invention |
| 9 | 70 (I = 4.3 mol %) | 64 | 0.27 | 155 | Present invention |

In Table 1, the sensitivity is represented by a relative value assuming that the sensitivity of the sample 1 is 100.

The average aspect ratio of all tabular grains, the variation coefficient of the equivalent-circle diameters of the projected areas of all the grains, and the ratio of a projected area occupied by hexagonal tabular grains were obtained by taking electron micrographs by using a transmission electron microscope in accordance with a replica method.

The distribution of the silver iodide contents of individual grains was obtained for each sample as follows. That is, the silver iodide contents of 200 emulsion grains were obtained by an X-ray microanalyzer method. Assuming that the mean value of these silver iodide contents was I mol %, the ratio of grains ranging between 0.7I and 1.3I was calculated.

In calculating the ratio of grains having 10 or more dislocation lines per grain, dislocation lines of 200 emulsion grains were observed by using a high-voltage electron microscope. (Each grain was observed at five sample inclination angles of −10°, −5°, 0°, +5°, and +10°.)

As can be seen from Table 1, the distribution of the silver iodide contents of individual grains was widened as the aspect ratio of tabular grains was increased, and an increase in sensitivity with increasing aspect ratio was small (the samples 1, 2, 3, and 4).

By narrowing the silver iodide content distribution, however, the sensitivity increased and the fog decreased as the aspect ratio was increased and the silver iodide content distribution was narrowed particularly in an emulsion in which the average aspect ratio of all tabular grains was 8 or more (the samples 5, 6, 7, 8, and 9).

This effect was notable especially when grain formation was done by rapidly generating iodide ions.

In addition, an emulsion in which the silver iodide content distribution was narrow and the ratio of grains having 10 or more dislocation lines was high was more preferable for the same average aspect ratio of all tabular grains (the samples 1 and 5), (the samples 2, 6, and 7), (the samples 3, 4, 8, and 9).

Furthermore, the sensitivity was more favorable when the variation coefficient of the equivalent-circle diameters of the projected areas of all grains was smaller (the samples 8 and 9).

An emulsion with a low fog and a high sensitivity can be obtained by the use of the emulsion of the present invention characterized in that, assuming that the specific silver iodide content is I mol % ($0.3<I<20$), silver halide grains ranging between 0.7I and 1.3I account for 100 to 50% of all grains, and an average aspect ratio of all tabular grains is 8 to 40.

EXAMPLE 2

Layers having the compositions presented below were coated on undercoated cellulose triacetate film supports to make samples 101 to 109 containing the emulsions 1-A to 1-I, respectively, described in Example 1 in the fifth layer (red-sensitive emulsion layer) of multi-layered color light-sensitive materials.

(Compositions of light-sensitive layers)

The main materials used in the individual layers are classified as follows.

| | | | |
|---|---|---|---|
| ExC: | Cyan coupler | UV: | Ultraviolet absorbent |
| ExM: | Magenta coupler | HBS: | High-boiling organic solvent |
| ExY: | Yellow coupler | H: | Gelatin hardener |
| ExS: | Sensitizing dye | | |

The number corresponding to each component indicates the coating amount in units of $g/m^2$. The coating amount of a silver halide is represented by the amount of silver. The coating amount of each sensitizing dye is represented in units of mols per mol of silver halide in the same layer.

(Samples 101 to 109)

| | |
|---|---|
| **1st layer (Antihalation layer)** | |
| Black colloidal silver | silver 0.18 |
| Gelatin | 1.40 |
| ExM-1 | 0.18 |
| ExF-1 | $2.0 \times 10^{-3}$ |
| HBS-1 | 0.20 |
| **2nd layer (Interlayer)** | |
| Emulsion G | silver 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| **3rd layer (Low-speed red-sensitive emulsion layer)** | |
| Emulsion A | silver 0.25 |
| Emulsion C | silver 0.25 |
| ExS-1 | $4.5 \times 10^{-4}$ |
| ExS-2 | $1.5 \times 10^{-5}$ |
| ExS-3 | $4.5 \times 10^{-4}$ |
| ExC-1 | 0.17 |
| ExC-3 | 0.030 |
| ExC-4 | 0.10 |
| ExC-5 | 0.0050 |
| ExC-7 | 0.0050 |
| ExC-8 | 0.020 |
| Cpd-2 | 0.025 |
| HBS-1 | 0.10 |
| Gelatin | 0.87 |
| **4th layer (Medium-speed red-sensitive emulsion layer)** | |
| Emulsion D | silver 0.80 |
| ExS-1 | $3.0 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.11 |
| ExC-7 | 0.0010 |
| ExC-8 | 0.025 |
| Cpd-2 | 0.023 |
| HBS-1 | 0.10 |
| Gelatin | 0.75 |
| **5th layer (High-speed red-sensitive emulsion layer)** | |
| Emulsion (one of 1-A to 1-I) | silver 1.40 |
| ExC-1 | 0.095 |
| ExC-3 | 0.040 |
| ExC-6 | 0.020 |
| ExC-8 | 0.007 |
| Cpd-2 | 0.050 |
| HBS-1 | 0.22 |
| HBS-2 | 0.10 |
| Gelatin | 1.20 |
| **6th layer (Interlayer)** | |
| Cpd-1 | 0.10 |
| HBS-1 | 0.50 |
| Gelatin | 1.10 |
| **7th layer (Low-speed green-sensitive emulsion layer)** | |
| Emulsion A | silver 0.17 |
| Emulsion B | silver 0.17 |
| ExS-4 | $4.0 \times 10^{-5}$ |
| ExS-5 | $1.8 \times 10^{-4}$ |
| ExS-6 | $6.5 \times 10^{-4}$ |
| ExM-1 | 0.010 |
| ExM-2 | 0.33 |
| ExM-3 | 0.086 |

-continued (Samples 101 to 109)

| | |
|---|---|
| ExY-1 | 0.015 |
| HBS-1 | 0.30 |
| HBS-3 | 0.010 |
| Gelatin | 0.73 |
| **8th layer (Medium-speed green-sensitive emulsion layer)** | |
| Emulsion D | silver 0.80 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.01 |
| ExY-5 | 0.030 |
| HBS-1 | 0.16 |
| HBS-3 | $8.0 \times 10^{-3}$ |
| Gelatin | 0.90 |
| **9th layer (High-speed green-sensitive emulsion layer)** | |
| Emulsion E | silver 1.25 |
| ExS-4 | $3.7 \times 10^{-5}$ |
| ExS-5 | $3.1 \times 10^{-5}$ |
| ExS-6 | $3.2 \times 10^{-4}$ |
| ExC-1 | 0.010 |
| ExM-1 | 0.015 |
| ExM-4 | 0.040 |
| ExM-5 | 0.019 |
| Cpd-3 | 0.020 |
| HBS-1 | 0.25 |
| HBS-2 | 0.10 |
| Gelatin | 1.20 |
| **10th layer (Yellow filter layer)** | |
| Yellow colloidal silver | silver 0.010 |
| Cpd-1 | 0.16 |
| HBS-1 | 0.60 |
| Gelatin | 0.60 |
| **11th layer (Low-speed blue-sensitive emulsion layer)** | |
| Emulsion C | silver 0.25 |
| Emulsion D | silver 0.40 |
| ExS-7 | $8.0 \times 10^{-4}$ |
| ExY-1 | 0.030 |
| ExY-2 | 0.55 |
| ExY-3 | 0.25 |
| ExY-4 | 0.020 |
| ExC-7 | 0.01 |
| HBS-1 | 0.35 |
| Gelatin | 1.30 |
| **12th layer (High-speed blue-sensitive emulsion layer)** | |
| Emulsion F | silver 1.38 |
| ExS-7 | $3.0 \times 10^{-4}$ |
| ExY-2 | 0.10 |
| ExY-3 | 0.10 |
| HBS-1 | 0.070 |
| Gelatin | 0.86 |
| **13th layer (1st protective layer)** | |
| Emulsion G | silver 0.20 |
| UV-4 | 0.11 |
| UV-5 | 0.17 |
| HBS-1 | $5.0 \times 10^{-2}$ |
| Gelatin | 1.00 |
| **14th layer (2nd protective layer)** | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, palladium salt, and rhodium salt. The emulsions represented by symbols are listed in Table 2 below.

TABLE 2

| | Average AgI content (%) | Average grain size (μm) | Variation coefficient (%) of grain size | Diameter/ thickness ratio | Silver amount ratio [core/intermediate/shell] (AgI content) | Grain structure/shape |
|---|---|---|---|---|---|---|
| Emulsion | | | | | | |
| A | 1.5 | 0.30 | 10 | 1 | [1/1] (1/2) | Double-structure cubic grain |
| B | 1.5 | 0.50 | 8 | 1 | [1/1] (1/2) | Double-structure cubic grain |
| C | 3.0 | 0.45 | 25 | 7 | [10/60/30] (0/1/8) | Triple-structure tabular grain |
| D | 2.8 | 0.80 | 18 | 6 | [14/56/30] (0.2/1/7.5) | Triple-structure tabular grain |
| E | 2.3 | 1.10 | 16 | 6 | [6/64/30] (0.2/1/5.5) | Triple-structure tabular grain |
| F | 13.6 | 1.75 | 26 | 3 | [1/2] (41/0) | Double-structure plate grain |
| G | 1.0 | 0.07 | 15 | 1 | — | Uniform-structure fine grain |

In Table 2, (1) The emulsions A to F were subjected to reduction sensitization during grain preparation by using thiourea dioxide and thiosulfonic acid in accordance with the experiments in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the experiments in JP-A-3-237450.

(3) The preparation of tabular grains was performed by using low-molecular weight gelatin in accordance with the embodiments in JP-A-1-158426.

(4) Dislocation lines as described in JP-A-3-237450 were observed in tabular grains when a high-voltage electron microscope was used.

The compounds used in the formation of the individual layers were as follows.

ExC-1
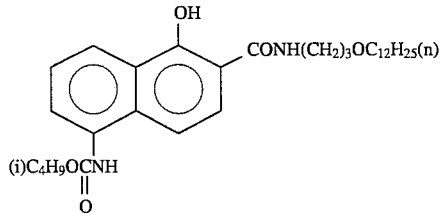
ExC-2
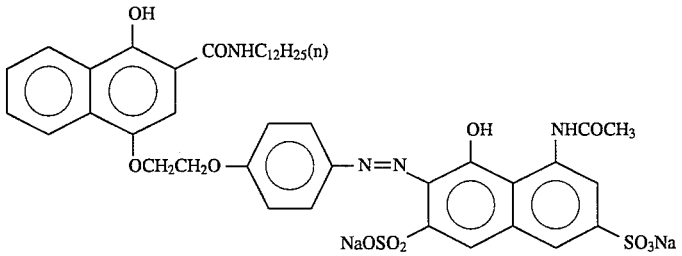
ExC-3
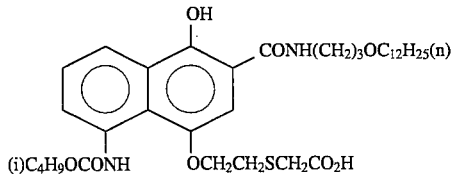
ExC-4
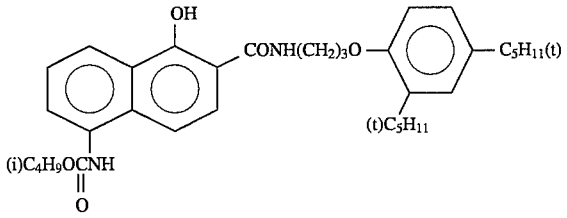
ExC-5
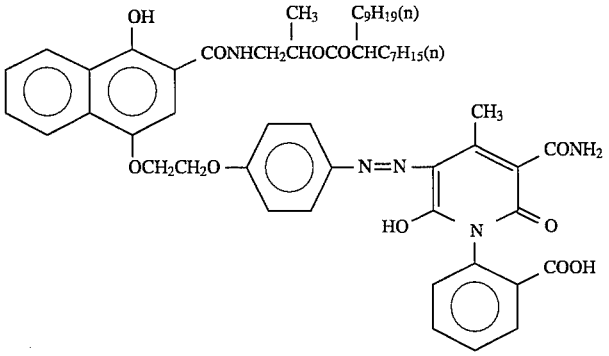
ExC-6
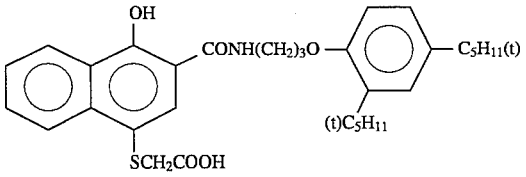

-continued
ExC-7
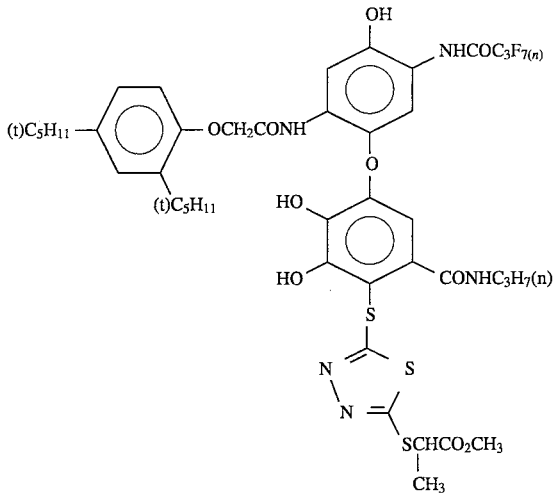
ExC-8
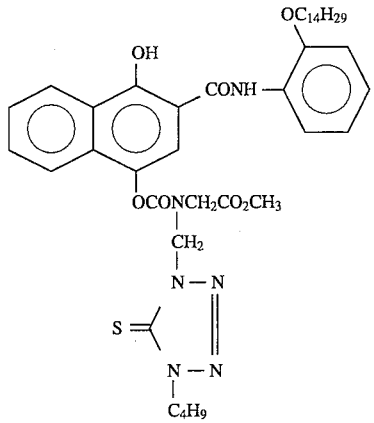
ExM-1
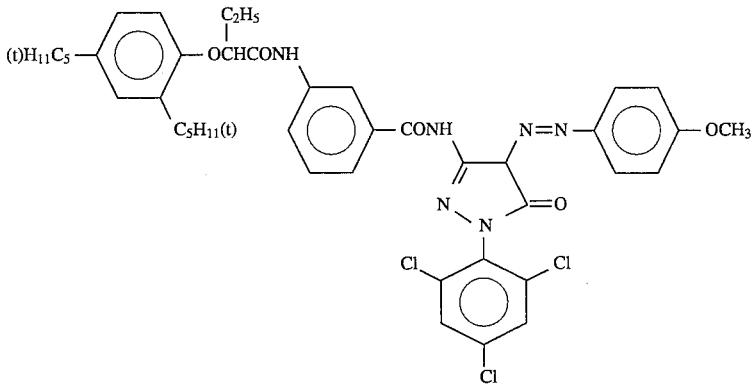

-continued
ExM-2
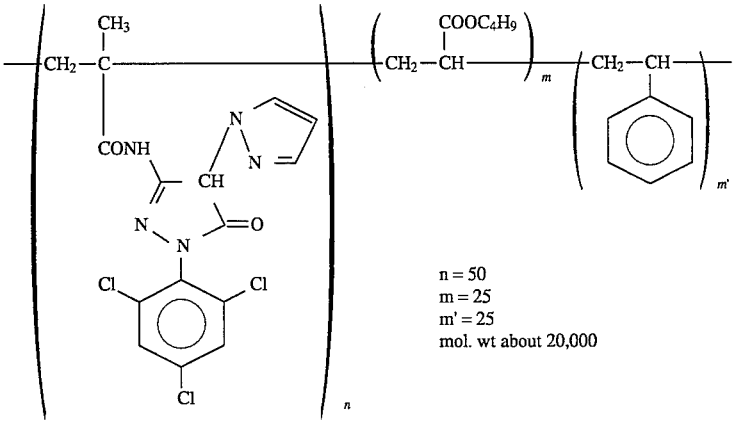
ExM-3
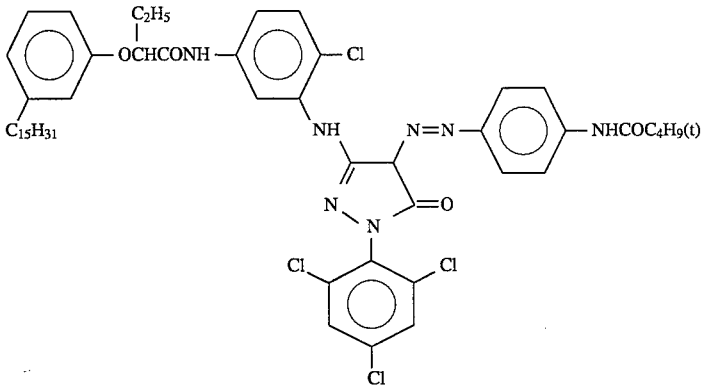
ExM-4
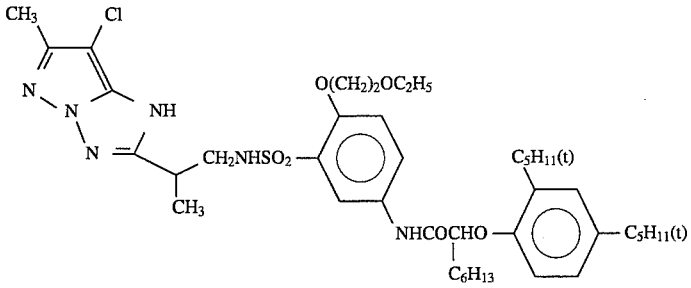
ExM-5
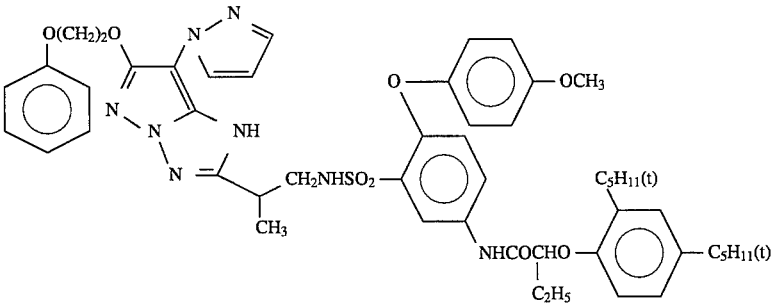
ExY-1
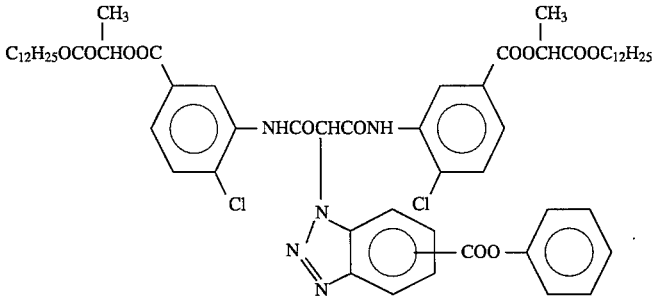

-continued
ExY-2
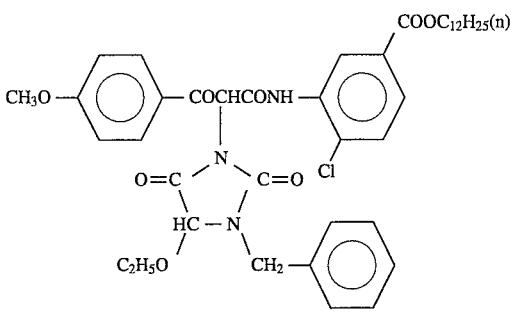
ExY-3
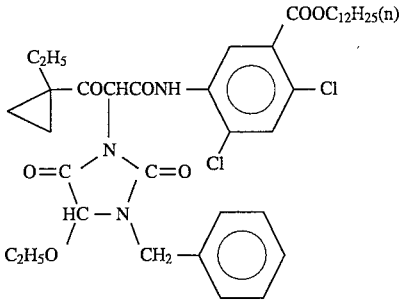
ExY-4
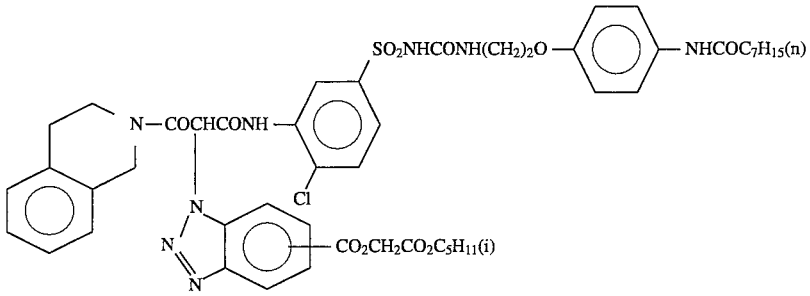
ExY-5
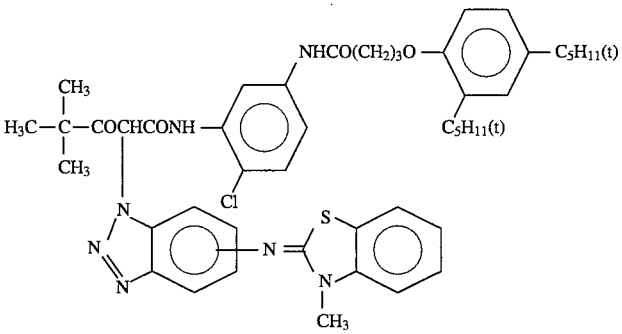
ExF-1
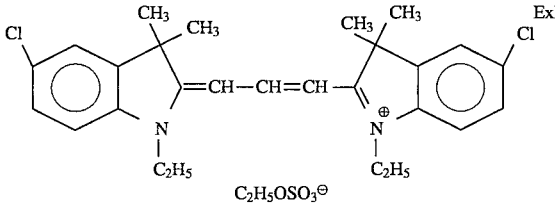
Cpd-1
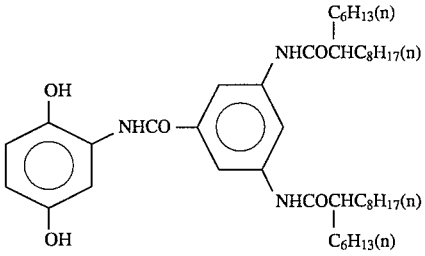
Cpd-2
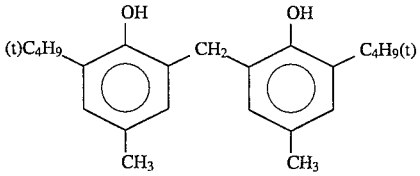
Cpd-3
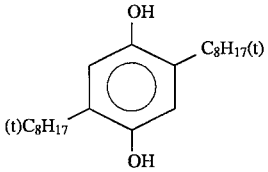
UV-1
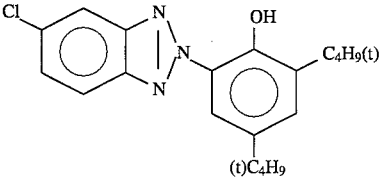
UV-2
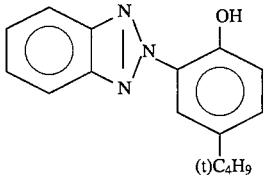

-continued
UV-3
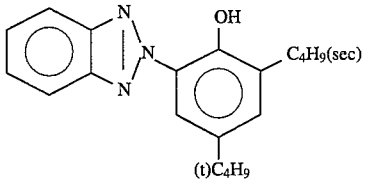
UV-4
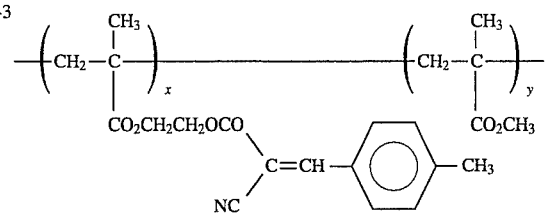
x:y = 70:30 (wt %)
UV-5
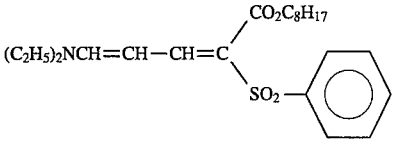
Tricresylphosphate HBS-1
Di-n-butylphthalate HBS-2
HBS-3
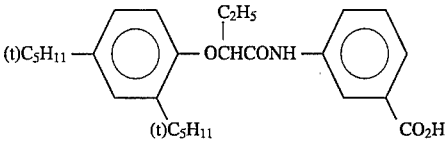
ExS-1
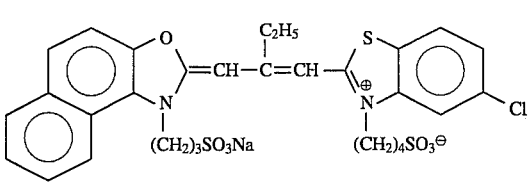
ExS-2
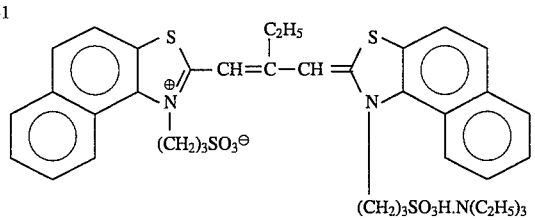
ExS-3
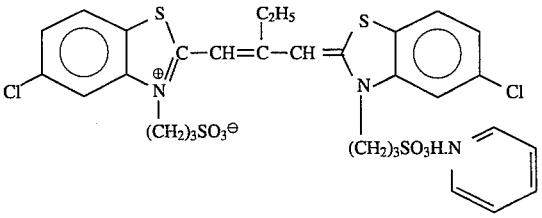
ExS-4
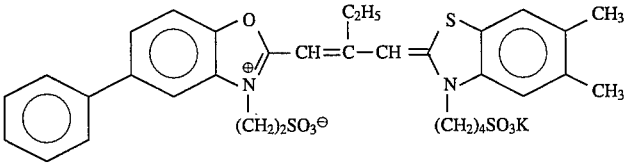
ExS-5
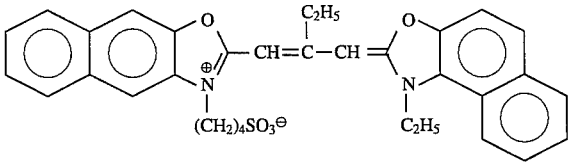
ExS-6
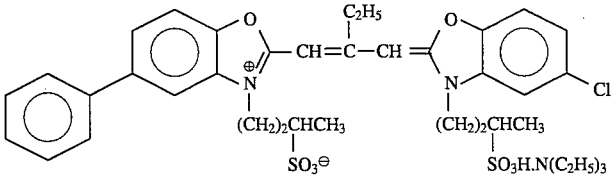

-continued
ExS-7
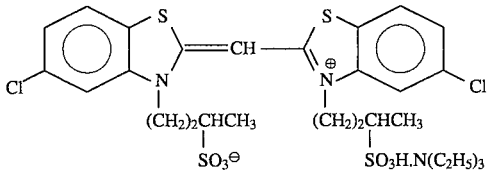
S-1
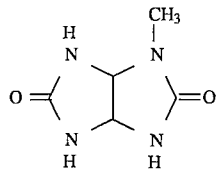
H-1
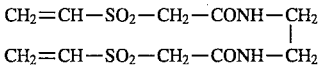
B-1
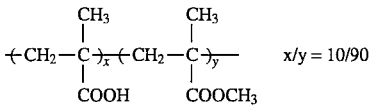
x/y = 10/90
B-2
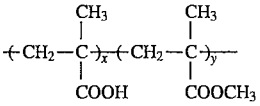
x/y = 40/60
B-3
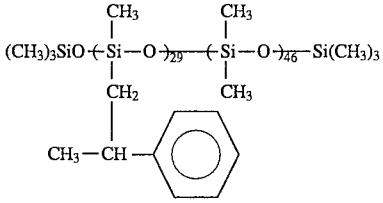
B-4
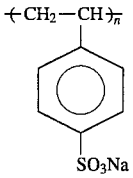
B-5
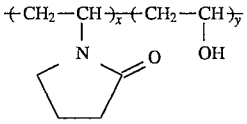
x/y = 70/30
B-6
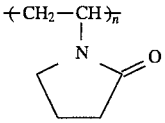
(mol. wt. about 10,000)
W-1
$C_8F_{17}SO_2NHCH_2CH_2CH_2OCH_2CH_2\overset{\ominus}{N}(CH_3)_3$
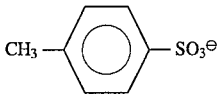
W-2
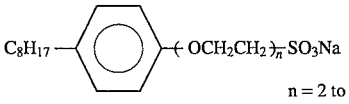
n = 2 to 4
W-3
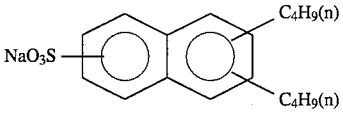
F-1
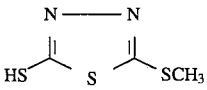
F-2
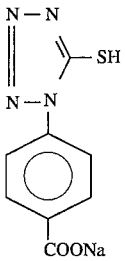
F-3
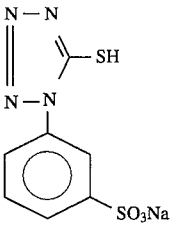
F-4
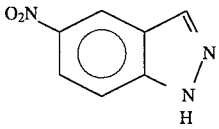
F-5
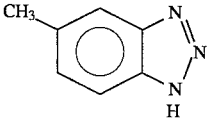
F-6
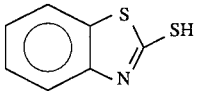

-continued

F-7

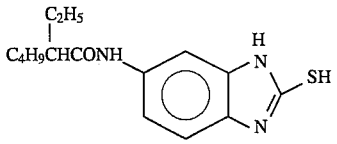

F-8

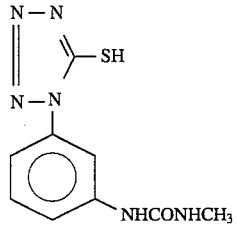

F-9

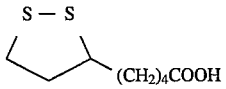

F-10

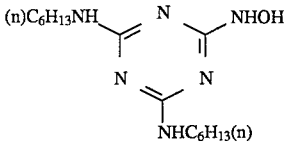

F-11

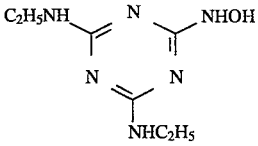

F-12

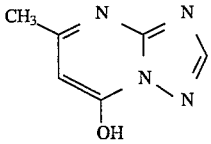

F-13

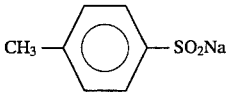

F-14

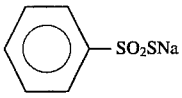

F-15

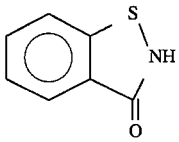

F-16

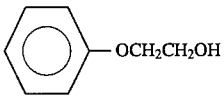

F-17

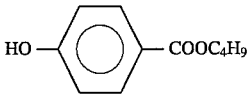

The samples 101 to 109 thus obtained were exposed and processed by the method described in Table C below.

TABLE C

| Processing Method | | |
|---|---|---|
| Process | Time | Temperature |
| Color development | 3 min. 15 sec. | 38° C. |
| Bleaching | 1 min. 00 sec. | 38° C. |
| Bleach-fixing | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

The compositions of the individual processing solutions are given below.

| | (g) |
|---|---|
| (Color developing solution) | |
| Diethylenetriaminepentaacetate | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |

-continued

| | (g) |
|---|---|
| Water to make | 1.0 l |
| pH | 10.05 |
| (Bleaching solution) | |
| Ferric ammonium ethylenediamine-tetraacetate dehydrate | 120.0 |
| Disodium ethylenediaminetetraacetate | 10.0 |
| Ammonium bromide | 100.0 |
| Ammonium nitrate | 10.0 |
| Bleaching accelerator $((CH_3)_2N—CH_2—CH_2—S—)_2.2HCl$ | 0.005 mol |
| Ammonia water (27%) | 15.0 ml |
| Water to make | 1.0 l |
| pH | 6.3 |
| (Bleach-fixing solution) | |
| Ferric ammonium ethylenediamine-tetraacetate dihydrate | 50.0 |
| Disodium ethylenediaminetetraacetate | 5.0 |
| Sodium sulfite | 12.0 |
| Ammonium thiosulfate aqueous solution (70%) | 240.0 ml |
| Ammonia water (27%) | 6.0 ml |
| Water to make | 1.0 l |
| pH | 7.2 |

(Washing solution)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution ranged from 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |

-continued

| (Stabilizing solution) | (g) |
|---|---|
| pH | 5.0–8.0 |

The sensitivity is represented by relative values of the reciprocals of exposure amounts by which a fog density and a density of fog density+0.2 are given on the characteristic curve of a cyan dye. The obtained results are summarized in Table 3 below.

TABLE 3

| Sample No. | Emulsion name | Average aspect ratio of all tabular grains | Variation coefficient of equivalent-circuit diameters of projected area of all grains | Projected area occupied by hexagonal tabular grains | Iodide ion supply source |
|---|---|---|---|---|---|
| 101 | 1-A | 7 | 13 (%) | 85 (%) | KI |
| 102 | 1-B | 11 | 16 | 90 | KI |
| 103 | 1-C | 15 | 18 | 88 | KI |
| 104 | 1-D | 15 | 18 | 88 | KI |
| 105 | 1-E | 7 | 13 | 85 | 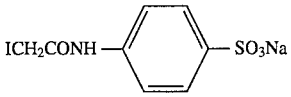 ($Na_2SO_3$ also was used) |
| 106 | 1-F | 11 | 16 | 90 | KI |
| 107 | 1-G | 11 | 16 | 90 | 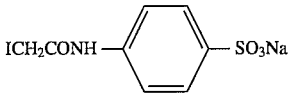 ($Na_2SO_3$ also was used) |
| 108 | 1-H | 15 | 18 | 88 | 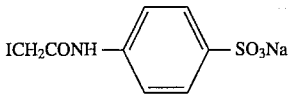 ($Na_2SO_3$ also was used) |
| 109 | 1-I | 15 | 20 | 87 | 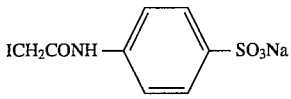 ($Na_2SO_3$ also was used) |

| Sample No. | Ratio of grains with silver iodide content of 0.7I to 1.3I (I is average silver iodide content) | Ratio of grains having 10 or more dislocations | Fog | Sensitivity | Remarks |
|---|---|---|---|---|---|
| 101 | 66 (%) (I = 2.2 mol %) | 79 (%) | 0.30 | 100 | Comparative example |
| 102 | 49 (I = 3.4 mol %) | 48 | 0.37 | 105 | Comparative example |
| 103 | 47 (I = 4.0 mol %) | 43 | 0.38 | 112 | Comparative example |
| 104 | 48 (I = 5.8 mol %) | 56 | 0.36 | 112 | Comparative example |
| 105 | 97 (I = 2.1 mol %) | 98 | 0.30 | 117 | Comparative example |
| 106 | 64 (I = 3.4 mol %) | 63 | 0.25 | 123 | Present invention |
| 107 | 86 (I = 3.2 mol %) | 85 | 0.25 | 129 | Present invention |
| 108 | 77 (I = 4.3 mol %) | 73 | 0.26 | 162 | Present invention |
| 109 | 70 (I = 4.3 mol %) | 64 | 0.27 | 158 | Present invention |

In Table 3, the sensitivities are represented by their respective relative values assuming that the sensitivity of the sample 101 is 100.

As in Example 1, each emulsion of the present invention had a low fog and a high sensitivity.

EXAMPLE 3

Tabular silver iodobromide emulsions were prepared by rapidly generating iodide ions following the same procedures as in Example 1 except that an equal molar quantity of a compound (2), (14), (15), (16), (19), or (63) was used in place of the compound (58) used in Example 1. Consequently, an increase in sensitivity and a decrease in fog as the effects of the present invention were nearly the same as those obtained when the compound (58) was used.

According to the present invention as has been described above, there can be provided an emulsion with a low fog and a high sensitivity.

What is claimed is:

1. A silver halide photographic light-sensitive material comprising a support having provided thereon a silver halide emulsion layer containing a silver halide emulsion in which, when a specific silver iodide content is I mol % ($0.3<I<20$), silver halide grains having a silver iodide content ranging between 0.7I and 1.3I and containing not less than 10 dislocation lines per grain on a fringe of said silver halide grains account for 100 to 50% of all grains, and an average aspect ratio of all tabular grains is 8 to 40.

2. The material according to claim 1, wherein said silver halide emulsion is an emulsion in which, when a specific silver iodide content is I mol % ($0.3<I< 20$), silver halide grains having a silver iodide content ranging between 0.7I and 1.3I account for 100 to 50% of all grains, and an average aspect ratio of all tabular grains is 12 to 40.

3. The material according to claim 1, wherein said silver halide emulsion is an emulsion in which hexagonal tabular grains, in each of which a ratio of a length of an edge with a maximum length to a length of an edge with a minimum length is 2 to 1, account for 100 to 50% of a total projected area of all grains.

4. The material according to claim 1, wherein said silver halide emulsion is an emulsion in which a variation coefficient of diameters of projected areas of all grains is 20 to 3%.

5. The material according to claim 4, wherein said silver halide emulsion is an emulsion in which a variation coefficient of diameters of projected areas of all grains is 15 to 3%.

6. The material according to claim 1, wherein the average aspect ratio of all tabular grains is 15 to 30.

7. The material according to claim 1, wherein the tabular grain has an equivalent-circle diameter of 0.3 to 10 μm.

8. The material according to claim 1, wherein the tabular grains have a thickness of 0.05 to 1.0 μm.

9. The material according to claim 1, wherein the range of the silver iodide content of emulsion grains is 0.1 to 20 mol %.

10. The material according to claim 1, wherein when a specific silver iodide content is I mol % ($0.3<I<20$), silver halide grains with a silver iodide content ranging between 0.7I and 1.31I account for 100 to 70% of all grains.

11. The material according to claim 1, wherein each tabular grain has 50 or more dislocation lines in its fringe portion.

12. A silver halide photographic light-sensitive material comprising a support having provided thereon a silver halide emulsion layer containing a silver halide emulsion in which, when a specific silver iodide content is I mol % ($0.3<I<20$), silver halide grains having a silver iodide content ranging between 0.7I and 1.3I and containing not less than 10 dislocation lines per grain on a fringe of said silver halide grains account for 100 to 50% of all grains, and an average aspect ratio of all tabular grains is 8 to 40, wherein said silver halide emulsion is an emulsion in which silver halide grains are formed while iodide ions are rapidly being generated.

13. The material according to claim 12, wherein said iodide ions are generated from an iodide ion-releasing agent placed in a reaction vessel, 50% to 100% of said iodide ion-releasing agent completes release of iodide ions within 180 consecutive seconds in the reaction vessel.

14. The material according to claim 12, wherein said iodide ions are rapidly being generated by a reaction of an iodide ion-releasing agent with an iodide ion release-controlling agent.

15. The material according to claim 12, wherein said reaction which iodide ions are rapidly being generated is a second-order reaction essentially proportional to a concentration of said iodide ion-releasing agent and a concentration of an iodide ion release-controlling agent, and a rate constant of the second-order reaction is 1,000 to $5\times10^{-3}M^{-1}.sec^{-1}$.

16. The material according to claim 12, wherein iodide ions are rapidly being generated from an iodide ion-releasing agent represented by Formula (I) below:

Formula (I)

R—I wherein R represents a monovalent organic residue which release the iodine atoms in the form of iodide ions upon reacting with a base and/or a nucleophilic reagent.

17. The material according to claim 16, wherein R is selected from the group consisting of an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl group having 2 to 30 carbon atoms, an aryloxycarbonyl group having 2 to 30 carbon atoms, an alkyl group having 1 to 30 carbon atoms, an arylsulfonyl group having 1 to 30 carbon atoms, and a sulfamoyl group.

* * * * *